US010710832B2

(12) United States Patent
Rozek et al.

(10) Patent No.: US 10,710,832 B2
(45) Date of Patent: Jul. 14, 2020

(54) CORE PLUG FOR A ROLL OF SHEET PRODUCT

(71) Applicant: GPCP IP Holdings LLC, Atlanta, GA (US)

(72) Inventors: Roy J. Rozek, Neenah, WI (US); Zachery J. VanDenBosch, Kaukauna, WI (US); Steven B. Mattheeussen, Fremont, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 350 days.

(21) Appl. No.: 15/475,906

(22) Filed: Mar. 31, 2017

(65) Prior Publication Data

US 2018/0194582 A1 Jul. 12, 2018

Related U.S. Application Data

(60) Provisional application No. 62/444,423, filed on Jan. 10, 2017.

(51) Int. Cl.
*B65H 16/06* (2006.01)
*B65H 16/00* (2006.01)
(Continued)

(52) U.S. Cl.
CPC ..... *B65H 16/06* (2013.01); *A47K 10/32* (2013.01); *A47K 10/34* (2013.01); *A47K 10/38* (2013.01); *A47K 10/405* (2013.01); *B65H 16/005* (2013.01); *B65H 75/185* (2013.01); *B65H 75/245* (2013.01); *A47K 10/10* (2013.01); *B65H 19/126* (2013.01); *B65H 2301/41369* (2013.01)

(58) Field of Classification Search
CPC .... B65H 16/06; B65H 16/005; B65H 19/126; B65H 75/00; B65H 75/02; B65H 75/18; B65H 75/185; B65H 75/187; B65H 75/245; B65H 75/24; B65H 2301/41346; A47K 10/38; A47K 10/40; A47K 10/405; A47K 10/34; A47K 10/32; B41J 11/00; B41J 15/00; B41J 13/00
USPC ..... 242/596, 596.1, 596.3, 596.7
See application file for complete search history.

(56) References Cited

U.S. PATENT DOCUMENTS 1,408,126 A * 2/1922 Mumm ..... B65H 75/185 242/596.7
2,269,939 A * 1/1942 Janisch ..... B65H 75/185 242/612
(Continued)

*Primary Examiner* — Emmanueal M Marcelo
*Assistant Examiner* — Raveen J Dias
(74) *Attorney, Agent, or Firm* — Eversheds Sutherland (US) LLP

(57) ABSTRACT

A core plug for supporting a roll of sheet product with respect to a sheet product dispenser is provided. The core plug may include a shell and a support. The shell may be positioned about a longitudinal axis of the core plug and configured to be at least partially inserted into a central opening of the roll of sheet product. The support may be movably attached to the shell and configured to engage a support feature of the sheet product dispenser such that the roll of sheet product is rotatably supported with respect to the sheet product dispenser. The support may be positioned at least partially within the shell, and at least a portion of the support may be configured to translate relative to the shell in the direction of the longitudinal axis of the core plug.

18 Claims, 14 Drawing Sheets

(51) Int. Cl.

| | |
|---|---|
| ***B65H 75/24*** | (2006.01) |
| ***A47K 10/40*** | (2006.01) |
| ***A47K 10/32*** | (2006.01) |
| ***A47K 10/38*** | (2006.01) |
| ***B65H 75/18*** | (2006.01) |
| ***B65H 19/12*** | (2006.01) |
| ***A47K 10/10*** | (2006.01) |
| ***A47K 10/34*** | (2006.01) |

(56) References Cited

U.S. PATENT DOCUMENTS 3,034,739 A * 5/1962 Barger ..... A47K 10/38 242/590
3,156,425 A * 11/1964 Mynchenberg ..... A47K 10/40 242/590
3,567,146 A * 3/1971 Arenson ..... B65H 75/185 242/613.5
3,627,220 A * 12/1971 Vogel ..... B65D 85/66 242/609
4,171,781 A * 10/1979 Kral ..... B65H 75/08 242/564.4
4,383,656 A * 5/1983 Campbell ..... B65H 75/185 242/590
4,610,407 A * 9/1986 Stubbmann ..... B65H 16/005 242/421.3
5,322,234 A * 6/1994 Robert ..... A47K 10/40 242/596.7
5,597,135 A * 1/1997 Vandersteene ..... B65H 16/005 242/599.3
6,019,308 A * 2/2000 Huang ..... B65B 67/085 242/588.2
6,092,758 A * 7/2000 Gemmell ..... A47K 10/40 242/596.4
6,883,292 B1 * 4/2005 Chen ..... B65B 11/04 53/389.1
9,211,043 B2 12/2015 Kling
9,642,504 B2 5/2017 Andersson et al.
10,172,501 B2 * 1/2019 Gscheidmeier ..... A47K 10/38
2006/0001729 A1 * 1/2006 Inana ..... B41J 11/0095 347/218
2007/0075180 A1 * 4/2007 Morand ..... A47K 10/40 242/596.7
2007/0131818 A1 * 6/2007 Ko ..... A47K 10/40 242/596.4
2008/0230418 A1 * 9/2008 Lind ..... A47K 10/36 206/413
2010/0236956 A1 * 9/2010 Kling ..... A47K 10/40 206/391
2011/0114777 A1 * 5/2011 Kling ..... A47K 10/40 242/160.1
2011/0114778 A1 * 5/2011 Andersson ..... A47K 10/40 242/160.1
2012/0032021 A1 * 2/2012 Morinaga ..... B65H 75/08 242/577
2015/0150422 A1 * 6/2015 Ochoa, Sr. ..... A47K 10/16 242/596.7
2016/0101637 A1 * 4/2016 Sasaki ..... B65H 16/06 347/104
2016/0198911 A1 * 7/2016 Ruiz ..... B65H 16/06 242/596.7

* cited by examiner

CORE PLUG FOR A ROLL OF SHEET PRODUCT

CROSS-REFERENCE TO RELATED APPLICATIONS

This application claims the benefit of U.S. Provisional Application No. 62/444,423, filed on Jan. 10, 2017, which is incorporated herein by reference in its entirety.

FIELD OF THE DISCLOSURE

The present disclosure relates generally to sheet products and sheet product dispensers and more particularly to core plugs for supporting a roll of sheet product with respect to a sheet product dispenser.

BACKGROUND

Various types of sheet product dispensers are known in the art, including mechanical and automated dispensers configured to dispense sheet product from a roll of sheet product that is rotatably supported by the dispenser. Paper towels, bath tissue, facial tissue, napkins, wipes, and other types of sheet product may be provided in roll form for dispensing from a sheet product dispenser. A roll of sheet product generally may include a web of sheet product that is wrapped around a longitudinal axis such that numerous layers of the sheet product are wound around one another. In this manner, sheet product may be dispensed by manually or automatically rotating the roll to unwind a portion of the sheet product from the roll and then separating the portion from a remainder of the roll for use. The roll of sheet product may include a central opening extending therethrough along the longitudinal axis of the roll. Certain rolls of sheet product may be coreless, such that the central opening of the roll is defined by an inner layer of the sheet product. Other rolls of sheet product may be cored, such that the central opening of the roll is defined by a core of paperboard or other material around which the layers of the sheet product are wound.

According to various sheet product dispenser configurations, the central opening of a roll of sheet product may be used to rotatably support the roll with respect to the sheet product dispenser. For example, certain sheet product dispensers may include a spindle or other type of support that extends through the entire length of the central opening and allows the roll of sheet product to rotate with respect to the sheet product dispenser. Other sheet product dispensers may be configured to support a roll of sheet product via one or more core plugs which are partially inserted into the central opening and allow the roll to rotate with respect to the sheet product dispenser. For example, a pair of separate core plugs may be used, with a first core plug partially inserted into the central opening at a first end of the roll and a second core plug partially inserted into the central opening at an opposite second end of the roll. The core plugs may be inserted into the central opening by a manufacturer after forming the roll of sheet product or may be inserted by an end user prior to loading the roll into a sheet product dispenser. Exposed portions of the core plugs (i.e., portions of the core plugs that extend outward from the ends of the roll of sheet product and are not positioned within the central opening) may be engaged and supported by one or more support features of the sheet product dispenser such that the roll may rotate with respect to the dispenser about a rotational axis for dispensing sheet product therefrom. Such support features may include one or more slots, channels, apertures, or other suitable receptacles configured to receive and support the exposed portions of the core plugs.

Certain sheet product dispensers may be configured to support only a single roll of sheet product at a time. Such single-roll dispensers may include a pair of support features, such as slots, channels, apertures, or other suitable receptacles configured to respectively receive and support a pair of core plugs inserted into the central aperture of a roll loaded in the dispenser. Other sheet product dispensers may be configured to support multiple rolls of sheet product at a time. Some multi-roll dispensers may include multiple pairs of support features, such as slots, channels, apertures, or other suitable receptacles, with each pair of support features configured to receive and support a respective pair of core plugs inserted into the central aperture of one of multiple rolls loaded in the dispenser. For example, this type of configuration may be used in a carousel style dispenser that allows sheet product to be dispensed only from a first roll located in a dispensing position and then allows the carousel to rotate a second roll into the dispensing position upon depletion of the first roll. Other multi-roll dispensers may include a single pair of support features, such as slots, channels, apertures, or other suitable receptacles configured to receive and support multiple pairs of core plugs inserted into the respective central apertures of multiple rolls loaded in the dispenser. For example, this type of configuration may be used in a stacked style dispenser that allows sheet product to be dispensed only from a first roll located in a dispensing position and then allows a second roll to slide or otherwise move into the dispensing position upon depletion of the first roll. Still other support feature configurations may be used in other sheet product dispensers to engage and support core plugs inserted into the central apertures of rolls of sheet product.

Existing core plugs generally may be formed as rigid or substantially rigid structures, a portion of which is intended to be inserted into the central opening of a roll of sheet product while an exposed portion of the core plug extends outward from the respective end of the roll. For example, such core plugs may be molded or otherwise formed from a hard plastic material and may be dimensioned and shaped such that the core plug is substantially inflexible and incompressible. As a result, such core plugs may have a fixed, non-adjustable axial length.

Although existing core plugs may provide a suitable connection between a roll of sheet product and respective support features of a sheet product dispenser in certain applications, use of such core plugs may present certain problems. Importantly, variations in the axial length of rolls of sheet product may exist from one roll to another roll, due to manufacturing tolerance ranges, process changes, or other reasons. Such variations may result in variations in the axial distance at which distal ends of a pair of core plugs are spaced apart from one another when properly inserted into the central aperture of a roll, which may affect engagement between the core plugs and respective support features of a dispenser. Additionally, variations in the distance between a pair of opposing support features of a dispenser may exist from one dispenser to another dispenser, due to manufacturing tolerance ranges, wear from continued use, or other reasons. Such variations may result in variations in the axial distance at which distal ends of a pair of core plugs need to be spaced apart from one another in order for the core plugs to properly engage the support features. Furthermore, variations in the axial distances along which a pair of core plugs are respectively inserted into the central opening of a roll may exist from one roll-and-core-plug assembly to another roll-and-core-plug assembly, due to manufacturing tolerance ranges (when the core plugs are inserted by a manufacturer), user error (when the core plugs are inserted by an end user), or other reasons. Such variations may result in variations in the axial distance at which distal ends of a pair of core plugs are spaced apart from one another when improperly inserted into the central aperture of a roll, which may affect engagement between the core plugs and respective support features of a dispenser. Ultimately, these types of variations, alone or in combination, may result in less engagement than desired between the core plugs and the respective support features of the dispenser. Such under-engagement may allow undesirable axial movement of the roll relative to the dispenser and, in some circumstances, may allow the roll to fall out of the dispenser, resulting in user frustration and poor user perception of the dispenser. Alternatively, these types of variations may result in more engagement than desired between the core plugs and the respective support features of the dispenser. Such over-engagement may undesirably restrict or even prevent rotation of the roll relative to the dispenser, resulting in user frustration and poor user perception of the dispenser. Finally, when existing core plugs are inserted into the central openings of rolls of sheet product by a manufacturer, the rigid core plugs may puncture or otherwise damage certain types of packaging or may themselves be damaged by certain types of packaging during shipment or handling.

There is thus a desire for improved core plugs for supporting a roll of sheet product with respect to a sheet product dispenser. Such core plugs should accommodate variations in the axial length of rolls of sheet product, variations in the distance between a pair of opposing support features of a dispenser, and/or variations in the axial distances along which the core plugs are inserted into the central opening of a roll, while also reducing incidence of under-engagement and over-engagement between the core plugs and respective support features of a dispenser. Additionally, such core plugs should reduce the likelihood of damage to packaging and/or the core plugs during shipment or handling of a roll-and-core-plug assembly.

SUMMARY

In one aspect, a core plug for supporting a roll of sheet product with respect to a sheet product dispenser is provided. According to one embodiment, the core plug may include a shell and a support. The shell may be positioned about a longitudinal axis of the core plug and configured to be at least partially inserted into a central opening of the roll of sheet product. The support may be movably attached to the shell and configured to engage a support feature of the sheet product dispenser such that the roll of sheet product is rotatably supported with respect to the sheet product dispenser. The support may be positioned at least partially within the shell, and at least a portion of the support may be configured to translate relative to the shell in the direction of the longitudinal axis of the core plug.

In another aspect, a sheet product roll assembly for a sheet product dispenser is provided. According to one embodiment, the sheet product roll assembly may include a roll of sheet product having a first end and an opposite second end positioned along a longitudinal axis of the roll of sheet product, a first core plug attached to the roll of sheet product at the first end of roll of sheet product, and a second core plug attached to the roll of sheet product at the second end of the roll of sheet product. The roll of sheet product may include a plurality of layers of sheet product wound around one another, and a central opening extending from the first end to the second end of the roll of sheet product. The first core plug and the second core plug each may include a shell and a support. The shell may be positioned about a longitudinal axis of the core plug and at least partially inserted into the central opening of the roll of sheet product. The support may be movably attached to the shell and configured to engage a support feature of the sheet product dispenser such that the roll of sheet product is rotatably supported with respect to the sheet product dispenser. The support may be positioned at least partially within the shell, and at least a portion of the support may be configured to translate relative to the shell in the direction of the longitudinal axis of the core plug.

In still another aspect, a sheet product dispensing system is provided. According to one embodiment, the sheet product dispensing system may include a sheet product dispenser, a roll of sheet product having a first end and an opposite second end positioned along a longitudinal axis of the roll of sheet product, a first core plug attached to the roll of sheet product at the first end of roll of sheet product, and a second core plug attached to the roll of sheet product at the second end of the roll of sheet product. The sheet product dispenser may include a first support feature, and a second support feature spaced apart from the first support feature. The roll of sheet product may include a plurality of layers of sheet product wound around one another, and a central opening extending from the first end to the second end of the roll of sheet product. The first core plug and the second core plug each may include a shell and a support. The shell may be positioned about a longitudinal axis of the core plug and at least partially inserted into the central opening of the roll of sheet product. The support may be movably attached to the shell and engaging the first support feature or the second support feature of the sheet product dispenser such that the roll of sheet product is rotatably supported with respect to the sheet product dispenser. The support may be positioned at least partially within the shell, and at least a portion of the support may be configured to translate relative to the shell in the direction of the longitudinal axis of the core plug.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1B:
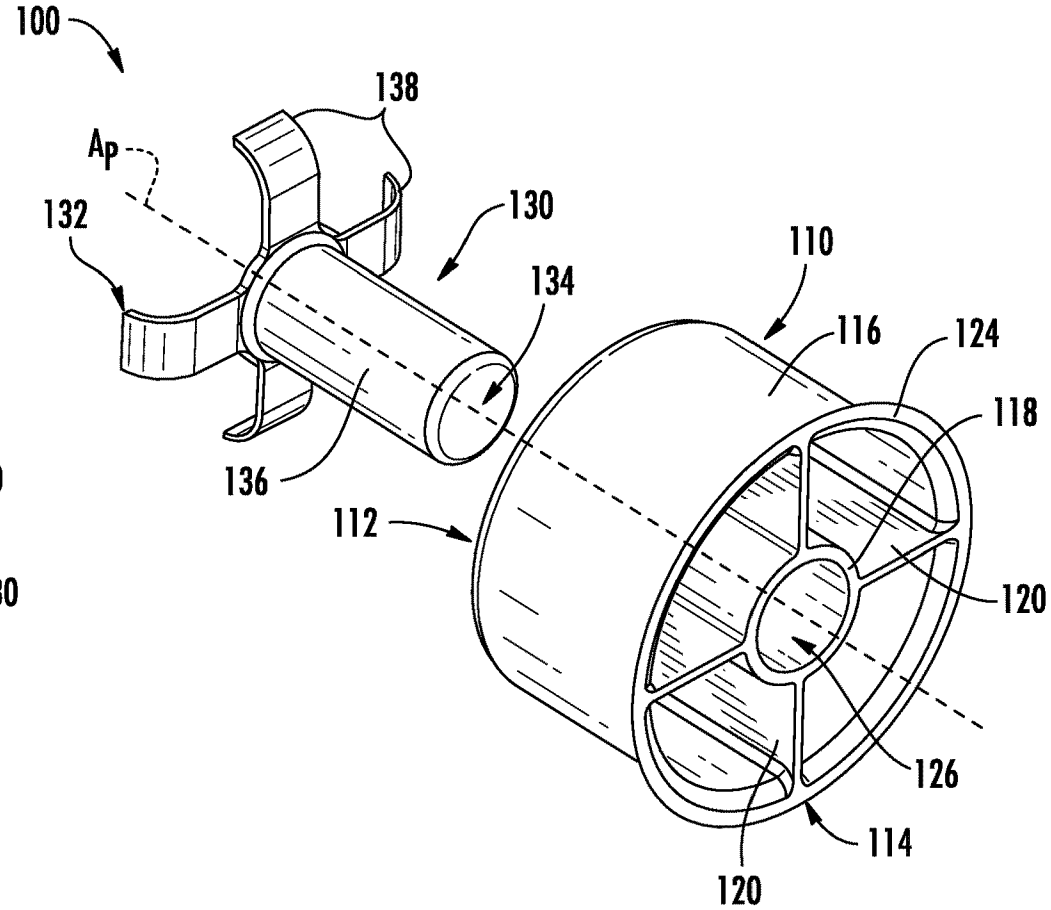
FIG. 1B is an exploded perspective view of the core plug of FIG. 1A, showing the shell and the support prior to assembly.

The core plugs described herein advantageously accommodate variations in the axial length of rolls of sheet product, variations in the distance between a pair of opposing support features of a dispenser, and/or variations in the axial distances along which the core plugs are inserted into the central opening of a roll. As described above, existing core plugs may be formed as rigid or substantially rigid structures having a fixed, non-adjustable axial length. Consequently, existing core plugs may be unable to accommodate variations in the axial length of sheet product rolls, variations in the distance between opposing dispenser support features, and/or variations in the axial distance along which the core plugs are inserted into the roll central opening, which may result in under-engagement or over-engagement between the core plugs and the respective dispenser support features. In contrast, the core plugs described herein are axially adjustable, which allows the core plugs to accommodate such variations, thereby reducing incidence of under-engagement or over-engagement between the core plugs and respective support features of a dispenser. In particular, portions of the core plugs may be axially retracted upon application of an external force by a user or mating features of a dispenser, and then may spring back toward or to an original, extended axial position upon removal of such force. In certain embodiments, the adjustable nature of the core plug may be provided by separate components that axially translate or otherwise move relative to one another. In other embodiments, the adjustable nature of the core plug may be provided by different features of a single component, which axially translate or otherwise move relative to one another while other features of the component flex, bend, or deform to allow such axial movement. The axially adjustable length of the core plugs also may reduce incidence of damage to certain types of packaging and/or the core plugs themselves during shipment or handling of a roll-and-core-plug assembly.

The present disclosure includes non-limiting embodiments of core plugs for supporting a roll of sheet product with respect to a dispenser. The embodiments are described in detail herein to enable one of ordinary skill in the art to practice the cores plugs and related methods of their use, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "sheet product" refers to a product that is relatively thin in comparison to its length and width and exhibits a relatively flat, planar configuration, yet is flexible or bendable to permit folding, rolling, stacking, or the like. Example sheet products include towel, bath tissue, facial tissue, napkin, wipe, or other sheet-like products. Sheet products may be made from paper, cloth, non-woven, metallic, polymer or other materials, and in some cases may include multiple layers or plies. In some embodiments, the sheet product may be a continuous sheet that is severable or separable into individual sheets using, for example, a tear bar or cutting blade, while in other cases the sheet product may include predefined areas of weakness, such as lines of perforations, that extend along the width of the sheet product to define individual sheets and facilitate separation or tearing.

The meanings of other terms used herein will be apparent to one of ordinary skill in the art or will become apparent to one of ordinary skill in the art upon review of the detailed description when taken in conjunction with the several drawings and the appended claims.

FIGS. 1A-1H illustrate a core plug 100 (which also may be referred to as a "sheet product roll core plug" or simply a "plug") according to one or more embodiments of the disclosure. The core plug 100 is configured to support a roll of sheet product with respect to a sheet product dispenser, as described below. In particular, the core plug 100 may be configured to be partially inserted into a central opening of the roll of sheet product and to engage one or more mating support features of the sheet product dispenser such that the roll is able to rotate with respect to the dispenser for dispensing sheet product therefrom. As described below, the core plug 100 is axially adjustable, which may allow the core plug 100 to accommodate variations in the axial length of rolls of sheet product, variations in the distance between a pair of opposing support features of a dispenser, and/or variations in the axial distances along which the core plugs 100 are inserted into the central opening of a roll, thereby reducing incidence of under-engagement or over-engagement between the core plugs 100 and respective support features of the dispenser.

Figure 1A:
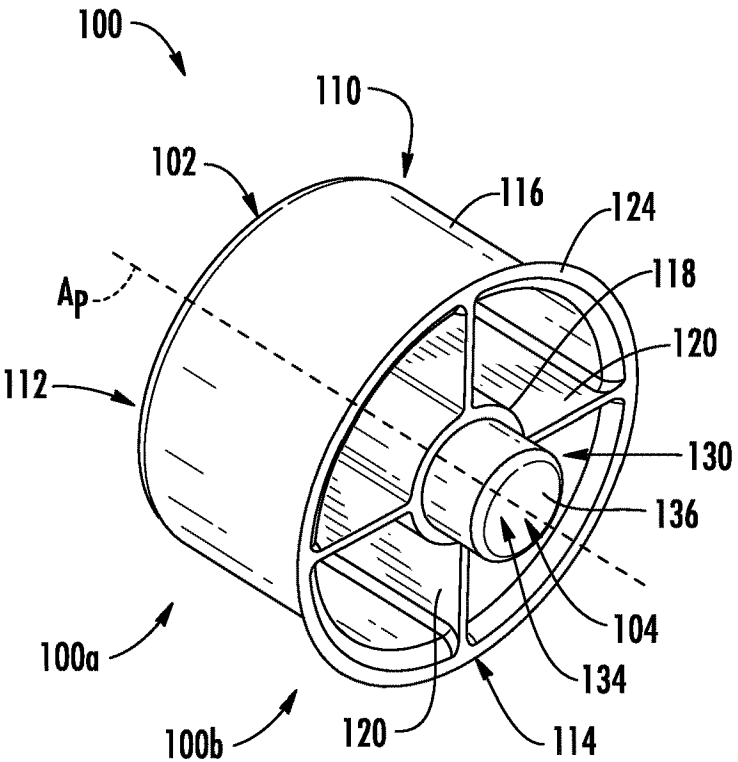
FIG. 1A is a perspective view of a core plug in accordance with one or more embodiments of the disclosure, showing a shell and a support of the core plug assembled to one another.
Figure 1D:
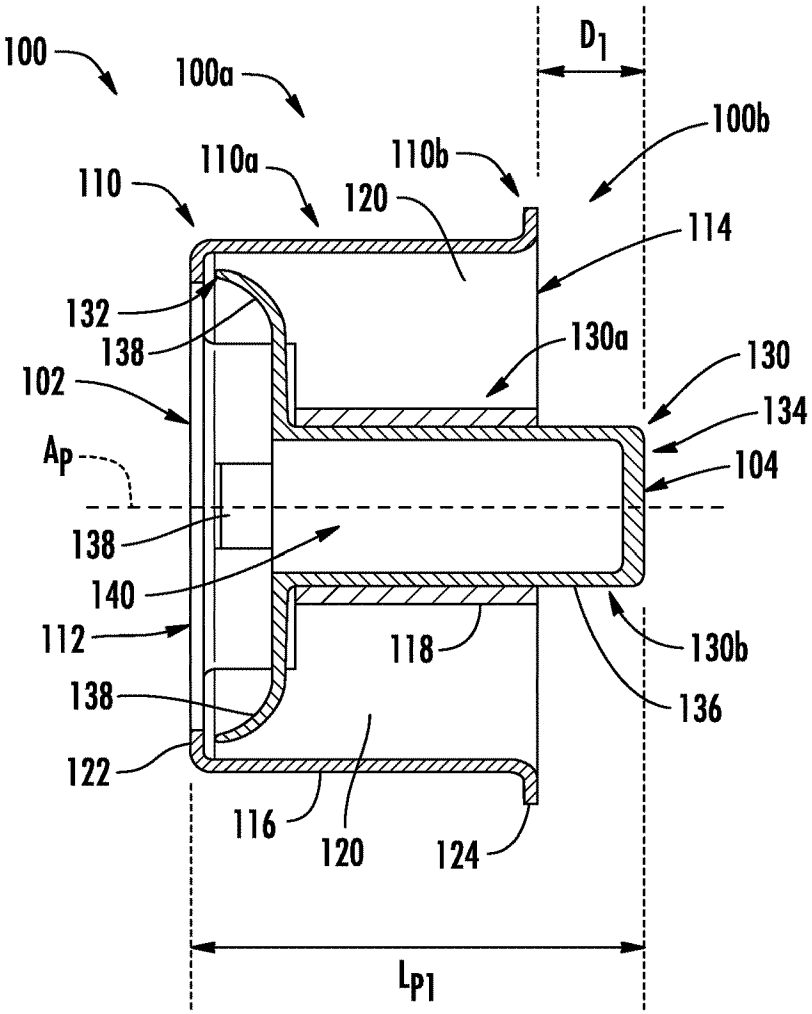
FIG. 1D is a cross-sectional top view of the core plug of FIG. 1A, taken along line 1D-1D of FIG. 1C, showing the support in the extended position relative to the shell.
Figure 1C:
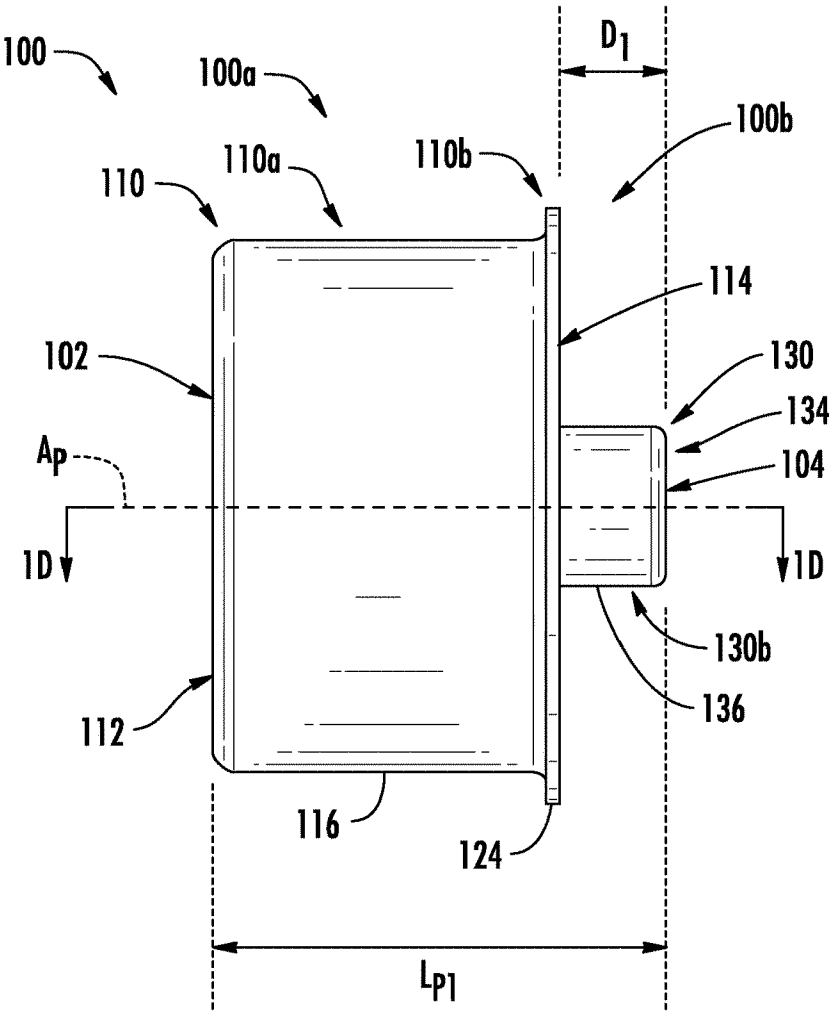
FIG. 1C is a side view of the core plug of FIG. 1A, showing the support in an extended position relative to the shell.
Figure 1F:
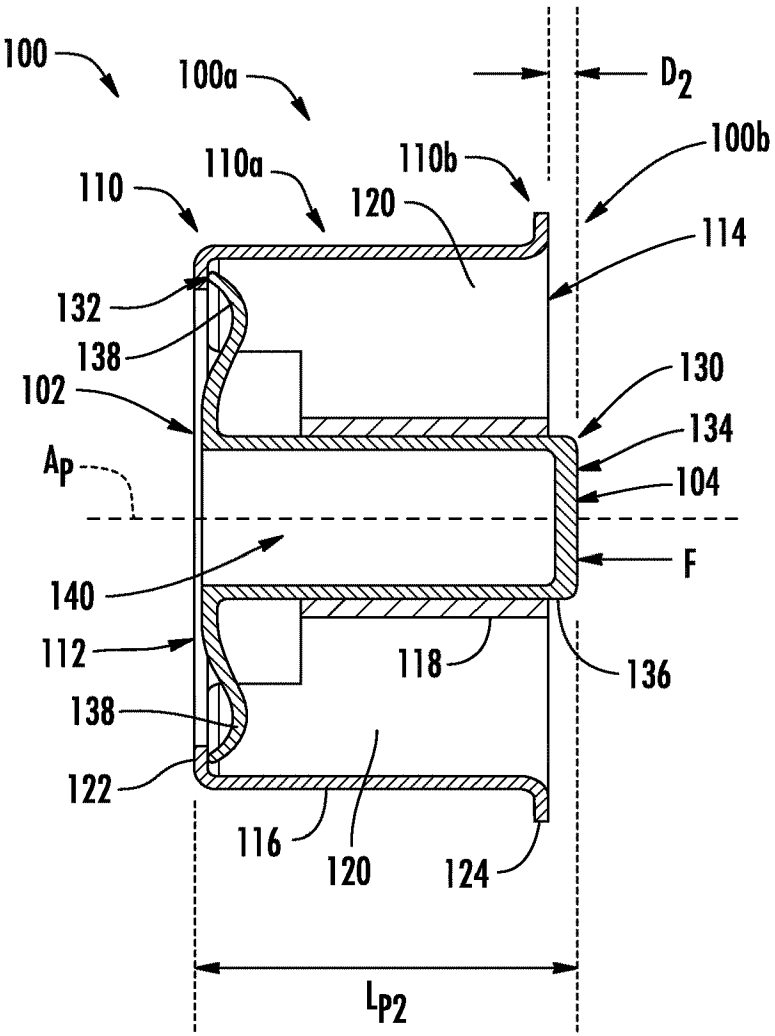
FIG. 1F is a cross-sectional top view of the core plug of FIG. 1A, taken along line 1F-1F of FIG. 1E, showing the support in the retracted position relative to the shell.
Figure 1E:
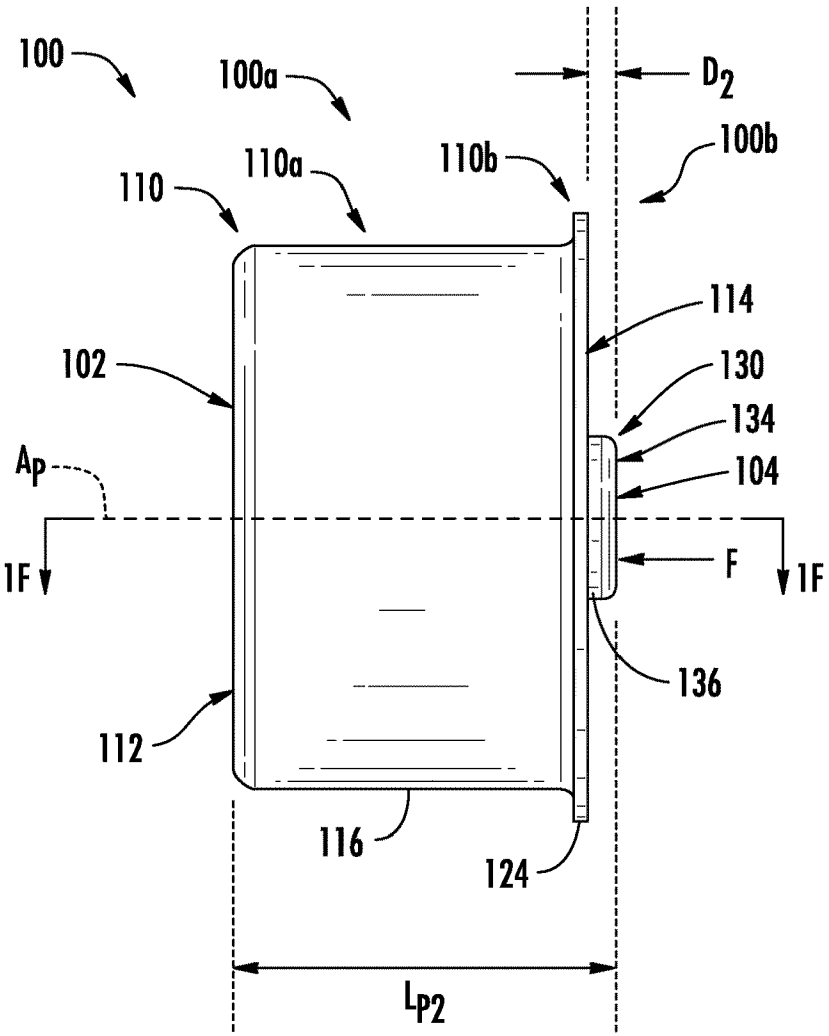
FIG. 1E is a side view of the core plug of FIG. 1A, showing the support in a retracted position relative to the shell.

As shown in FIGS. 1A-1F, the core plug 100 may have a first end 102 (which also may be referred to as an "inner end") and a second end 104 (which also may be referred to as an "outer end") positioned along a longitudinal axis $A_P$ of the core plug 100. During use of the core plug 100, the first end 102 may be positioned within the central opening of a roll, while the second end 104 is positioned outside of the central opening and spaced apart from the respective end of the roll. The core plug 100 may include a shell 110 (which also may be referred to as an "outer shell" or an "outer member") and a support 130 (which also may be referred to as an "inner support" or an "inner member"). As shown, the shell 110 and the support 130 may be separate components that are separately formed and assembled to one another. The support 130 may be positioned at least partially within the shell 110 and movable with respect to the shell 110. In particular, the support 130 may be configured to move between an extended position, as shown in FIGS. 1A, 1C, and 1D, and a retracted position, as shown in FIGS. 1E and 1F, with respect to the shell 110. Further details regarding the assembly of the shell 110 and the support 130 as well as the movement of the support 130 relative to the shell 110 are described below.

The shell 110 may have a first end 112 (which also may be referred to as an "inner end") and a second end 114 (which also may be referred to as an "outer end") positioned along a longitudinal axis of the shell 110. As shown, the shell 110 may include a collar 116 (which also may be referred to as an "outer cylinder"), a hub 118 (which also may be referred to as an "inner cylinder"), and a plurality of spokes 120 (which also may be referred to as "arms"). The hub 118 may be positioned at least partially within the collar 116 and spaced apart from the collar 116, and each of the spokes 120 may extend outward from the hub 118 to the collar 116. In certain embodiments, as shown, the hub 118 may be concentric with the collar 116 (i.e., the longitudinal axis of the hub 118 is coaxial with the longitudinal axis of the collar 116), and the spokes 120 may extend radially from the hub 118 to the collar 116 and be arranged in a circumferential array about the longitudinal axis of the shell 110. In this manner, the shell 110 may include a number of openings defined between adjacent spokes 120 and respective portions of the hub 118 and the collar 116. In certain embodiments, the collar 116, the hub 118, and the spokes 120 may be integrally formed with one another to form the shell 110. In other words, the collar 116, the hub 118, and the spokes 120 may be formed as a single component. In other embodiments, one or more of the collar 116, the hub 118, and the spokes 120 may be separately formed and fixedly (i.e., permanently) attached to one another to form the shell 110. In certain embodiments, the shell 110 may be formed of a plastic, for example by injection molding, although other suitable materials and methods of manufacture may be used. In other embodiments, the shell 110 may be formed of a metal, such as zinc, for example by die-casting, although other suitable materials and methods of manufacture may be used. In certain embodiments, the shell 110 may be rigid or substantially rigid, such that the collar 116, the hub 118, and the spokes 120 are inflexible and incompressible or are substantially inflexible and substantially incompressible in the direction of the longitudinal axis of the shell 110.

As shown, the collar 116 may have a generally cylindrical shape with a circular cross-sectional shape taken perpendicular to the longitudinal axis of the shell 110, although other suitable shapes of the collar 116 may be used. In certain embodiments, as shown, the collar 116 may extend from the first end 112 to the second end 114 of the shell 110, although other positions of the collar 116 may be used. In certain embodiments, the collar 116 may have a constant or substantially constant outer diameter along a majority of or the entire axial length of the collar 116. In other embodiments, the collar 116 may have an outer diameter that decreases along a majority of or the entire axial length of the collar 116 in the direction from the second end 114 toward the first end 112 of the shell 110 to facilitate insertion of the shell 110 into the central opening of a roll of sheet product. As shown, the collar 116 may include a first lip 122 (which also may be referred to as an "inner lip") positioned at or near the first end 112 of the shell 110, and a second lip 124 (which also may be referred to as an "outer lip") positioned at or near the second end 114 of the shell 110. The first lip 122 may extend radially inward toward the longitudinal axis of the shell 110 and may be configured to retain the support 130 within the shell 110, as described below. The second lip 124 may extend radially outward away from the longitudinal axis of the shell 110 and may be configured to limit insertion of the shell 110, and thus the overall core plug 100, into the central opening of a roll of sheet product, as described below. In certain embodiments, as shown, each of the first lip 122 and the second lip 124 may be formed as a flange extending along the entire circumference of the collar 116. In other embodiments, one or both of the first lip 122 and the second lip 124 may extend along only a portion of the circumference of the collar 116.

The hub 118 also may have a generally cylindrical shape with a circular cross-sectional shape taken perpendicular to the longitudinal axis of the shell 110, although other suitable shapes of the hub 118 may be used. In certain embodiments, as shown, the hub 118 may be spaced apart from the first end 112 of the shell 110 and may extend to the second end 114 of the shell 110, although other positions of the hub 118 may be used. The hub 118 may include a central opening 126 extending axially from a first end to a second end of the hub 118 and configured to receive a portion of the support 130 therein. In certain embodiments, as shown, the central opening 126 may have a generally cylindrical shape with a circular cross-sectional shape taken perpendicular to the longitudinal axis of the shell 110, although other suitable shapes of the central opening 126 may be used.

As shown, each of the spokes 120 may have a generally planar shape extending parallel or substantially parallel to the longitudinal axis of the shell 110, although other suitable shapes of the spokes 120 may be used. In certain embodiments, as shown, each of the spokes 120 may be spaced apart from the first end 112 of the shell 110 and may extend to the second end 114 of the shell 110, although other positions of the spokes 120 may be used. Each of the spokes

120 may be attached to the collar 116 and the hub 118, such that the collar 116 and the hub 118 are maintained in a concentric relationship. As shown, a number of openings, each extending from the first end 112 to the second end 114 of the shell 110, may be defined between each pair of adjacent spokes 120 and respective portions of the collar 116 and the hub 118. In certain embodiments, the spokes 120 may be arranged in a circumferential array about the longitudinal axis of the shell 110, although other arrangements of the spokes 120 may be used. Although the illustrated embodiment includes four spokes 120 that are equally spaced apart from one another in the circumferential direction, any number of spokes 120 and alternative spacings of the spokes 120 may be used.

During use of the core plug 100, a first portion 110*a* (which also may be referred to as an "inserted portion") of the shell 110 may be inserted into the central opening of a roll of sheet product, while a second portion 110*b* (which also may be referred to as an "exposed portion") of the shell 110 may be positioned outside of the central opening of the roll and extend outwardly from a respective end of the roll. In certain embodiments, the first portion 110*a* may include a portion of the collar 116, a portion of the hub 118, and a portion of each of the spokes 120, and the second portion 110*b* may include a portion of the collar 116, a portion of the hub 118, and a portion of each of the spokes 120. Alternative arrangements of the first portion 110*a* and the second portion 110*b* may be used.

The support 130 may have a first end 132 (which also may be referred to as an "inner end") and a second end 134 (which also may be referred to as an "outer end") positioned along a longitudinal axis of the support 130. As shown, the support 130 may include a body 136 (which also may be referred to as a "support body" or a "cylinder") and a plurality of arms 138 (which also may be referred to as "spring arms" or "wings"). Each of the arms 138 may extend outward from the body 136 and be arranged in a circumferential array about the longitudinal axis of the support 130. In certain embodiments, the body 136 and the arms 138 may be integrally formed with one another to form the support 130. In other words, the body 136 and the arms 138 may be formed as a single component. In other embodiments, the body 136 and the arms 138 may be separately formed and fixedly (i.e., permanently) attached to one another to form the support 130. In certain embodiments, the support 130 may be formed of a plastic, for example by injection molding, although other suitable materials and methods of manufacture may be used. In certain embodiments, a portion of the support 130 may be rigid or substantially rigid, and another portion of the support 130 may be flexible. In particular, the body 136 may be rigid or substantially rigid, such that the body is inflexible and incompressible or is substantially inflexible and substantially incompressible in the direction of the longitudinal axis of the support 130, and the arms 138 may be flexible and/or compressible in the direction of the longitudinal axis of the support 130.

As shown, the body 136 may have a generally cylindrical shape with a circular cross-sectional shape taken perpendicular to the longitudinal axis of the support 130, although other suitable shapes of the body 136 may be used. In certain embodiments, as shown, the body 136 may be spaced apart from the first end 132 of the support 130 and may extend to the second end 134 of the support 130, although other positions of the body 136 may be used. In certain embodiments, the body 136 may have a constant or substantially constant outer diameter along a majority of or the entire axial length of the body 136. In other embodiments, the body 136 may have an outer diameter that varies along the axial length of the body 136. In certain embodiments, as shown, the body 136 may be hollow, such that the body 136 includes a central opening 140 defined therein. The central opening 140 may extend along the longitudinal axis of the support 130. In certain embodiments, as shown, the body 136 may have an open end and a closed end. In other embodiments, the central opening 140 may extend entirely through the body 136, such that both ends of the body 136 are open.

Each of the arms 138 may have a contoured shape extending radially outward from the body 136 and axially away from the body 136 toward the first end 132 of the support 130, although other suitable shapes of the arms 138 may be used. In certain embodiments, at least a portion of each of the arms 138 may be curved to extend in the axial direction toward the first end 132 of the support 130. In other embodiments, each of the arms 138 may have a generally planar shape and may be angled at an acute angle relative to the longitudinal axis of the support 130, such that the arms 138 extend radially outward from the body 136 and axially away from the body 136 toward the first end 132 of the support 130. Each of the arms 138 may be attached to the body 136 and arranged in a circumferential array about the longitudinal axis of the support 130, although other arrangements of the arms 138 may be used. Although the illustrated embodiment includes four arms 138 that are equally spaced apart from one another in the circumferential direction, any number of arms 138 and alternative spacings of the arms 138 may be used. The arms 138 may be resiliently flexible such that the arms 138 may be elastically deflected (i.e., deformed) relative to the body 136 toward the second end 134 of the support 130 upon application of an external force and then return to their original position upon removal of such force.

During use of the core plug 100, a first portion 130*a* (which also may be referred to as an "inserted portion") of the support 130 may be inserted into the central opening of a roll of sheet product, while a second portion 130*b* (which also may be referred to as an "exposed portion") of the support 130 may be positioned outside of the central opening of the roll and extend outwardly from a respective end of the roll. In certain embodiments, the first portion 130*a* may include a portion of the body 136 and the entirety of each of the arms 138, and the second portion 130*b* may include a portion of the body 136. Alternative arrangements of the first portion 130*a* and the second portion 130*b* may be used.

As shown, the support 130 may be movably attached to the shell 110 to form the core plug 100. The core plug 100 may be assembled by inserting the body 136 of the support 130 through the central opening 126 of the hub 118 of the shell 110 and axially advancing the support 130 relative to the shell 110 until the arms 138 of the support 130 are received within the collar 116 of the shell 110. As the arms 138 engage the first lip 122 of the collar 116, the first lip 122 may elastically deflect the arms 138 radially inward toward the longitudinal axis of the support 130, such that the arms 138 may pass into the collar 116. Once the arms 138 are axially advanced past the first lip 122, the arms 138 may return to or toward their original position relative to the body 136.

Upon assembly of the core plug 100, the support 130 may be movably retained by the shell 110. As shown, the body 136 of the support 130 may be positioned within the central opening 126 of the hub 118 of the shell 110, which may limit lateral movement of the support 130 relative to the shell 110. Additionally, contact between the hub 118 and the arms 138 of the support 130 may limit axial movement of the support 130 relative to the shell 110 in a first direction, and contact between the first lip 122 of the collar 116 and the arms 138 may limit axial movement of the support 130 relative to the shell 110 in an opposite second direction.

As described above, the support 130 may be configured to move relative to the shell 110 between an extended position, as shown in FIGS. 1A, 1C, and 1D, and a retracted position, as shown in FIGS. 1E and 1F. In particular, a portion of the support 130, such as the body 136, may be configured to translate relative to the shell 110 upon application of an external axial force F to the body 136 while the position of the shell 110 is maintained. Upon application of the external axial force F, the arms 138 of the support 130 may contact the first lip 122 and elastically deflect (i.e., deform) relative to the body 136 toward the second end 134 of the support 130 while the body 136 translates relative to the hub 118. Upon removal of the external axial force F, the arms 138 may spring back and return to their original position relative to the body 136, thereby biasing the body 136 to translate relative to the hub 118. When the support 130 is in the extended position, the core plug 100 may have a first axial length $L_{P1}$ and the support 130 may extend beyond the shell 110 by a first axial distance $D_1$. When the support 130 is in the retracted position, the core plug 100 may have a second axial length $L_{P2}$ and the support 130 may extend beyond the shell 110 by a second axial distance $D_2$. As shown, the second axial length $L_{P2}$ may be less than the first axial length $L_{P1}$, and the second axial distance $D_2$ may be less than the first axial distance $D_1$.

During use of the core plug 100, a first portion 100*a* (which also may be referred to as an "inserted portion") of the core plug 100 may be inserted into the central opening of a roll of sheet product, while a second portion 100*b* (which also may be referred to as an "exposed portion") of the core plug 100 may be positioned outside of the central opening of the roll and extend outwardly from a respective end of the roll. The first portion 100*a* of the core plug 100 may include the first portion 110*a* of the shell 110 and the first portion 130*a* of the support 130, and the second portion 100*b* of the core plug 100 may include the second portion 110*b* of the shell 110 and the second portion 130*b* of the support 130.

Figure 1G:
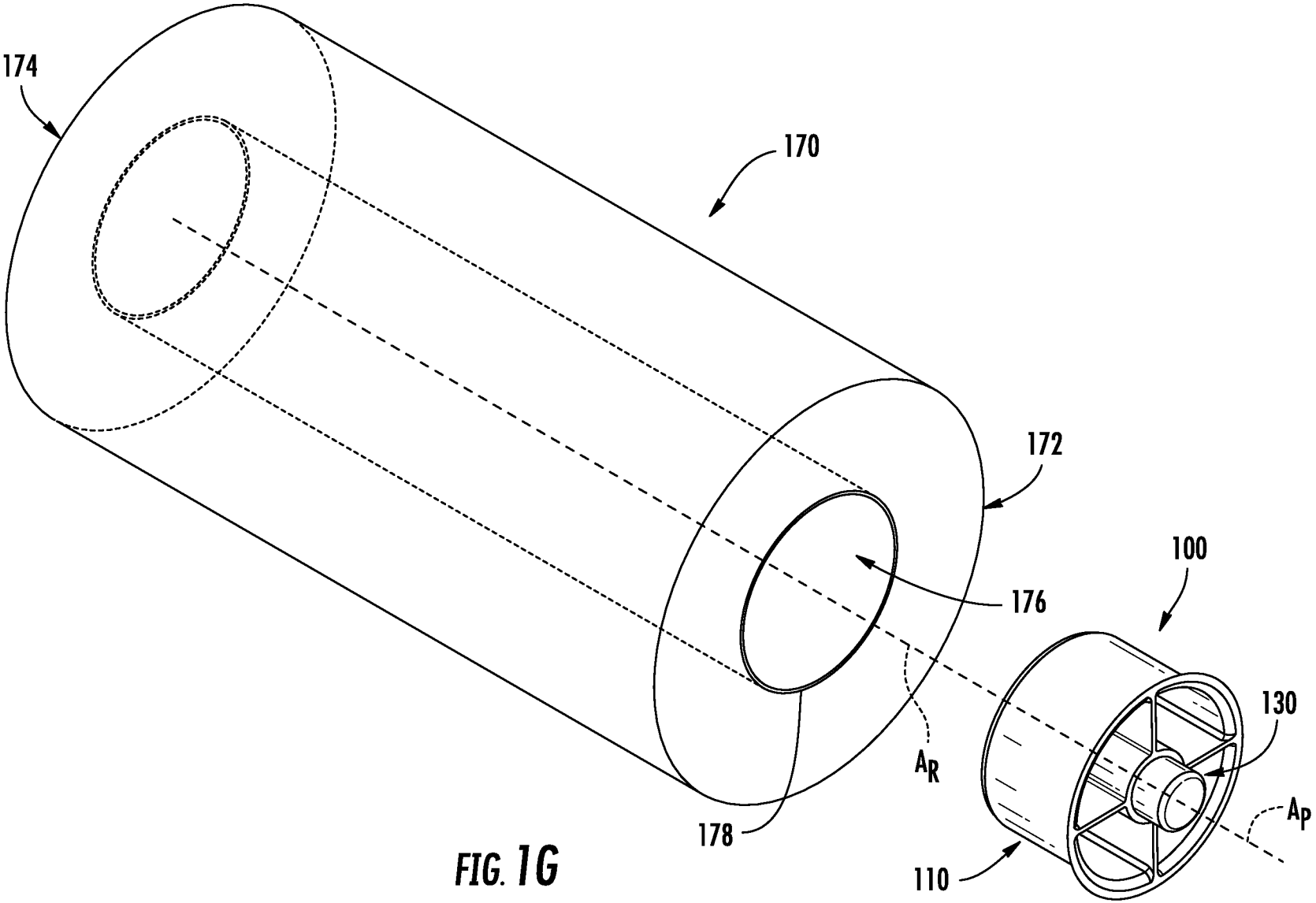
FIG. 1G is a perspective view of the core plug of FIG. 1A and a roll of sheet product.
Figure 1H:
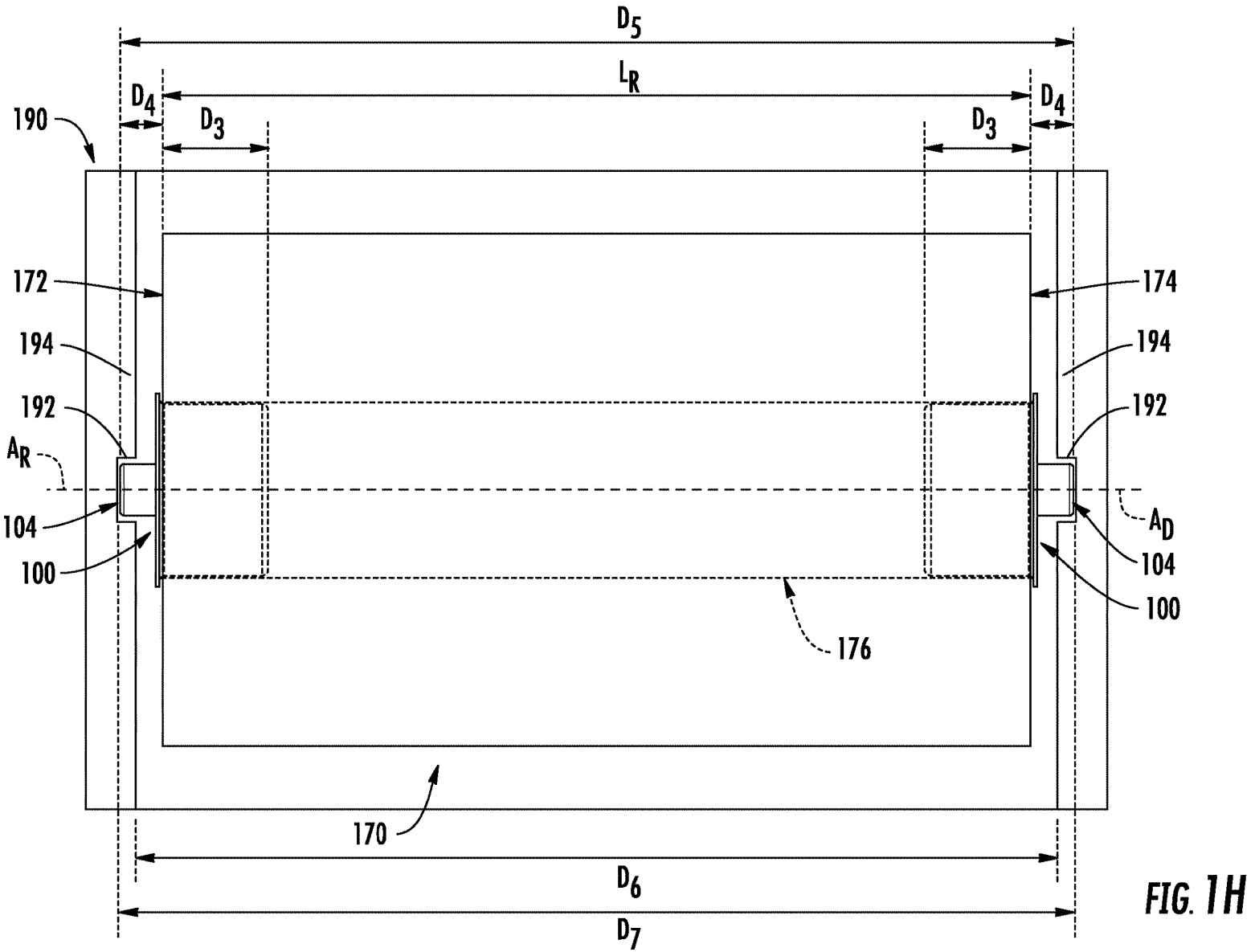
FIG. 1H is a plan view of the roll of sheet product supported with respect to a sheet product dispenser by two of the core plugs of FIG. 1A.

FIGS. 1G and 1H illustrate use of the core plug 100 to support a roll 170 of sheet product with respect to a sheet product dispenser 190. The roll 170 of sheet product may be formed in a conventional manner, whereby layers of the sheet product are wound around one another. The roll 170 may be elongated in shape, having a first end 172 and an opposite second end 174 positioned along a longitudinal axis $A_R$ of the roll 170, and an axial length $L_R$ from the first end 172 to the second end 174. As shown, the roll 170 may include a central opening 176 extending therethrough along the longitudinal axis $A_R$ of the roll 170, from the first end 172 to the second end 174. In certain embodiments, as shown, the roll 170 may be a cored roll of sheet product, including a core 178 of paperboard or other material which defines the central opening 176 and around which the layers of the sheet product are wound. In other embodiments, the roll 170 may be a coreless roll of sheet product, such that the central opening 176 is defined by an inner layer of the sheet product. The sheet product of the roll 170 may be paper towels, bath tissue, facial tissue, napkins, wipes, or other types of sheet product, according to various embodiments.

The core plug 100 may be attached to the roll 170 of sheet product by inserting the first portion 100*a* of the core plug 100 into the central opening 176 at one of the ends 172, 174 of the roll 170. The collar 116 of the shell 110 may be secured within the central opening 176 by a press-fit and/or an adhesive may be applied to interfaces of the collar 116 and the central opening 176 to secure the core plug 100 to the roll 170. The second lip 124 of the collar 116 may limit insertion of the core plug 100 into the central opening 176 and indicate full insertion of the core plug 100 has been achieved when the second lip 124 contacts the respective end 172, 174 of the roll 170. When the core plug 100 is attached to the roll 170, the first portion 100*a* of the core plug 100 is received within the central opening 176, and the second portion 100*b* of the core plug 100 is positioned outside of the central opening 176 and extends outward from the respective end 172, 174 of the roll 170. As shown, the first portion 100*a* may be inserted within the central opening 176 along an axial distance $D_3$, and the second portion 100*b* may extend beyond the respective end 172, 174 of the roll 170 by an axial distance $D_4$. Two separate core plugs 100 may be attached to the roll 170 in this manner, as shown in FIG. 1H, to form a roll-and-core-plug assembly. With both core plugs 100 attached to the roll 170, the opposite second ends 104 of the core plugs 100 (i.e., the ends of the bodies 136 of the core plugs 100) may be spaced apart from one another by an axial di stance $D_5$.

The sheet product dispenser 190 may include a plurality of support features 192 each configured to engage and support one or more core plugs 100, such that one or more rolls 170 of sheet product may rotate with respect to the dispenser 190 about a rotational axis $A_D$ for dispensing sheet product therefrom. According to various embodiments, the support features 192 may be slots, channels, apertures, or other suitable receptacles configured to receive and support mating portions of the core plugs 100, such as portions of the bodies 136. In certain embodiments, as shown, the support features 192 may be defined in a pair of opposing walls 194 of the dispenser 190. In other embodiments, the support features 192 may be defined in one or more support arms or other form of support members of the dispenser 190. Although the illustrated embodiment includes a pair of support features 192, any number of support features may be used to rotatably support any number of rolls 170 of sheet product. As shown, the walls 194 may be spaced apart from one another by an axial distance $D_6$, and the opposite ends of the support features 192 may be spaced apart from one another by an axial distance $D_7$. In certain embodiments, the sheet product dispenser 190 may be a single-roll dispenser configured to support only a single roll 170 of sheet product at a time. In other embodiments, the sheet product dispenser 190 may be a multi-roll dispenser configured to support multiple rolls 170 of sheet product at a time.

The roll 170 of sheet product, with the core plugs 100 attached thereto, may be loaded into the sheet product dispenser 190 by inserting the bodies 136 of the supports 130 of the core plugs 100 into the respective support features 192, as shown in FIG. 1H. The method of inserting the bodies 136 into the respective support features 192 may vary, depending on the configuration of the support features 192 and the overall dispenser 190. In certain embodiments, the bodies 136 may be slid into or otherwise inserted into the support features 192 while the supports 130 are in the extended position, for example, when the support features 192 are slots or channels having an open end for initial insertion. In other embodiments, the supports 130 may be moved from the extended position to or toward the retracted position while the bodies 136 are positioned with respect to the support features 192, at which point the supports 130 may be allowed to return to or toward the extended position and engage the support features 192. Such movement of the supports 130 relative to the shells 110 may be performed by a user or may be facilitated by mating features of the dispenser 190 as a user loads the roll 170 therein. Upon insertion, the bodies 136 may be rotatably received within the respective support features 192 such that the roll 170 is able to rotate with respect to the dispenser 190 for dispensing sheet product therefrom.

As noted above, the axially adjustable nature of the core plugs 100 may reduce incidence of under-engagement or over-engagement between the core plugs 100 and the respective support features 192, even when certain variations exist. For example, when the axial length $L_R$ of the roll 170 of sheet product is less than intended, the supports 130 of the core plugs 100 may assume the extended position such that the axial distance $D_5$ is greater than the axial distance $D_6$. Additionally, when the axial length $L_R$ of the roll 170 of sheet product is greater than intended, the supports 130 of the core plugs 100 may assume a retracted position such that the axial distance $D_5$ is equal to or less than the axial distance $D_7$. As another example, when the axial distance $D_6$ between the walls 194 is greater than intended and/or the axial distance $D_7$ between the ends of the support features 192 is greater than intended, the supports 130 of the core plugs 100 may assume the extended position such that the axial distance $D_5$ is greater than the axial distance $D_6$. Additionally, when the axial distance $D_6$ between the walls 194 is less than intended and/or the axial distance $D_7$ between the ends of the support features 192 is less than intended, the supports 130 of the core plugs 100 may assume a retracted position such that the axial distance $D_5$ is equal to or less than the axial distance $D_7$. As still another example, when the axial distance $D_3$ along which one or both of the core plugs 100 is inserted into the central aperture 176 of the roll 170 is less than intended (i.e., one or both of the core plugs 100 is not fully inserted), the supports 130 of the core plugs 100 may assume a retracted position such that the axial distance $D_5$ is equal to or less than the axial distance $D_7$. In this manner, the core plugs 100 may facilitate desired engagement between the core plugs 100 and the support features 192 and prevent, or at least reduce the likelihood of, the problems associated with under-engagement and over-engagement.

FIGS. 2A-2H illustrate a core plug 200 (which also may be referred to as a "sheet product roll core plug" or simply a "plug") according to one or more embodiments of the disclosure. The core plug 200 is configured to support a roll of sheet product with respect to a sheet product dispenser, as described below. In particular, the core plug 200 may be configured to be partially inserted into a central opening of the roll of sheet product and to engage one or more mating support features of the sheet product dispenser such that the roll is able to rotate with respect to the dispenser for dispensing sheet product therefrom. As described below, the core plug 200 is axially adjustable, which may allow the core plug 200 to accommodate variations in the axial length of rolls of sheet product, variations in the distance between a pair of opposing support features of a dispenser, and/or variations in the axial distances along which the core plugs 200 are inserted into the central opening of a roll, thereby reducing incidence of under-engagement or over-engagement between the core plugs 200 and respective support features of the dispenser.

Figure 2B:
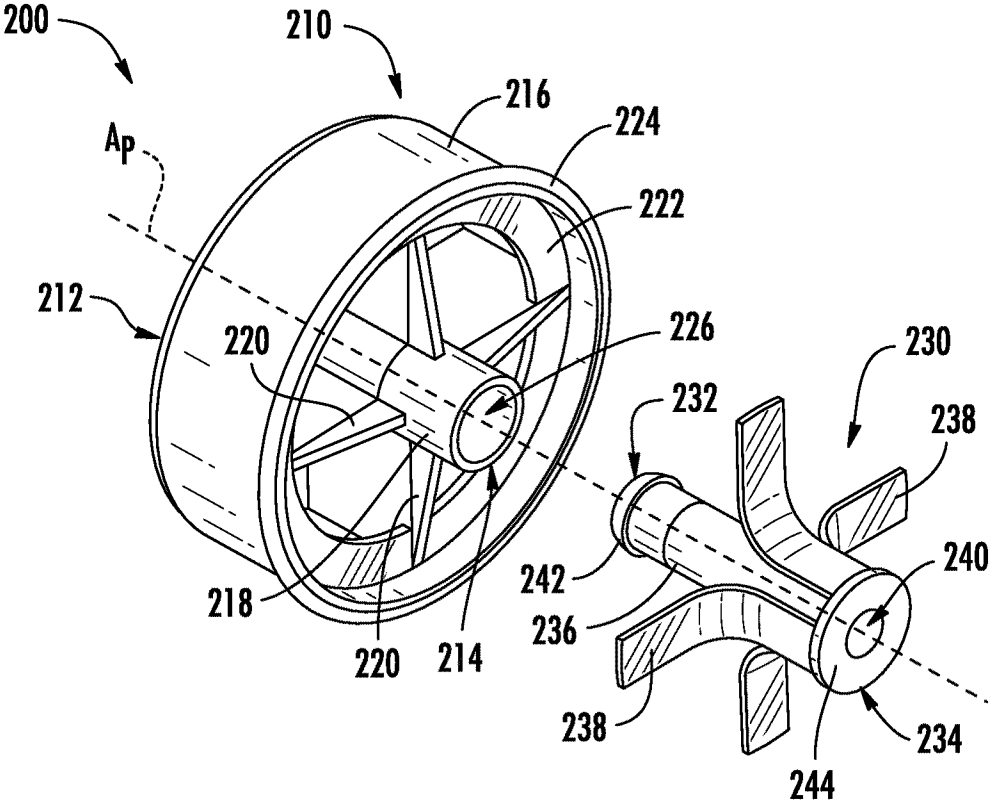
FIG. 2B is an exploded perspective view of the core plug of FIG. 2A, showing the shell and the support prior to assembly.
Figure 2A:
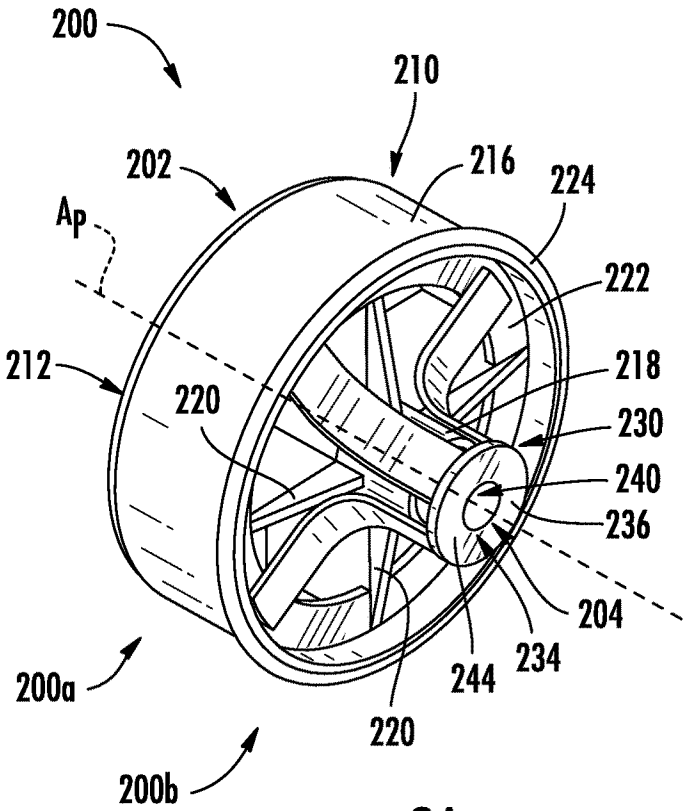
FIG. 2A is a perspective view of a core plug in accordance with one or more embodiments of the disclosure, showing a shell and a support of the core plug assembled to one another.
Figure 2D:
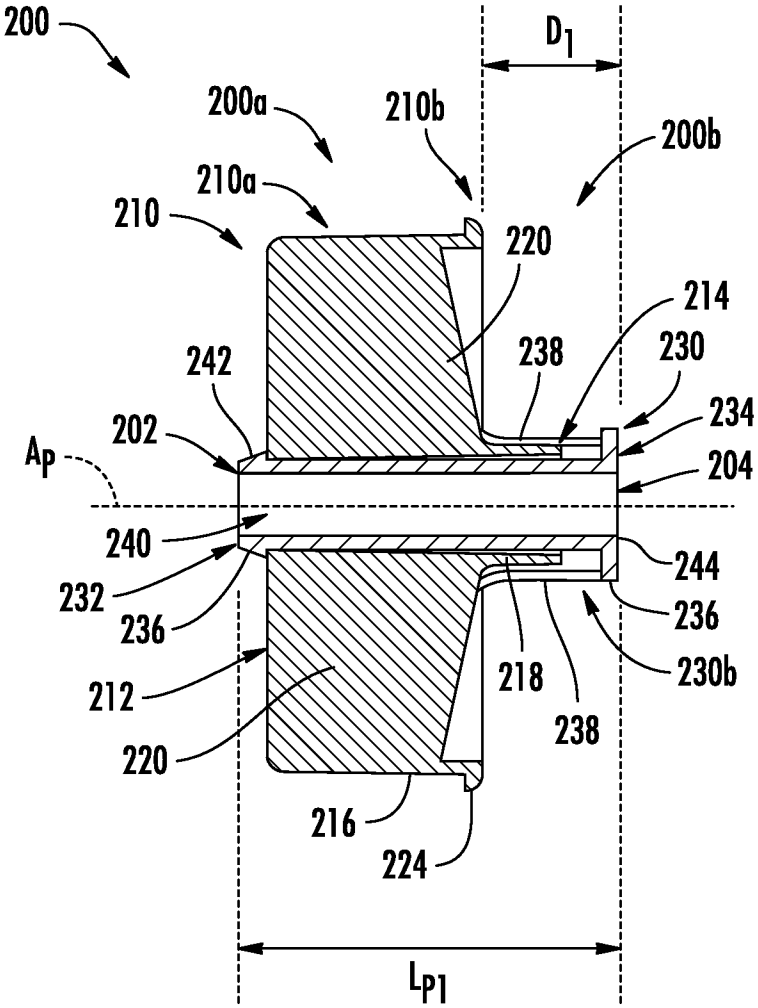
FIG. 2D is a cross-sectional top view of the core plug of FIG. 2A, taken along line 2D-2D of FIG. 2C, showing the support in the extended position relative to the shell.
Figure 2C:
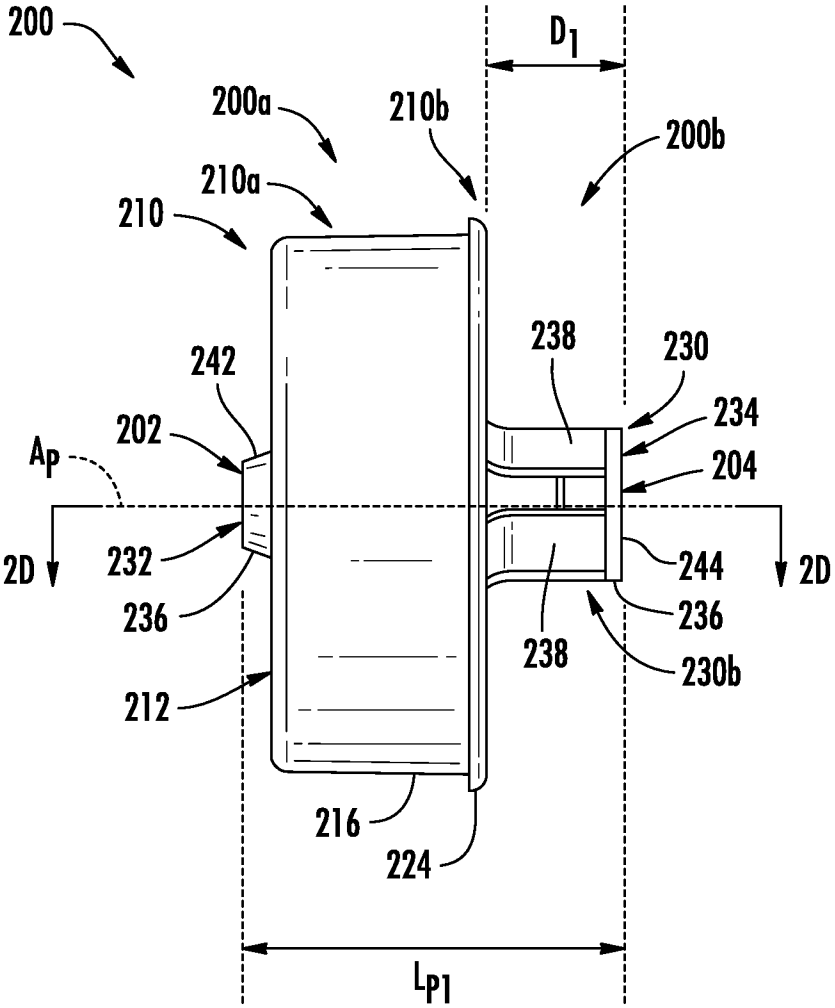
FIG. 2C is a side view of the core plug of FIG. 2A, showing the support in an extended position relative to the shell.
Figure 2F:
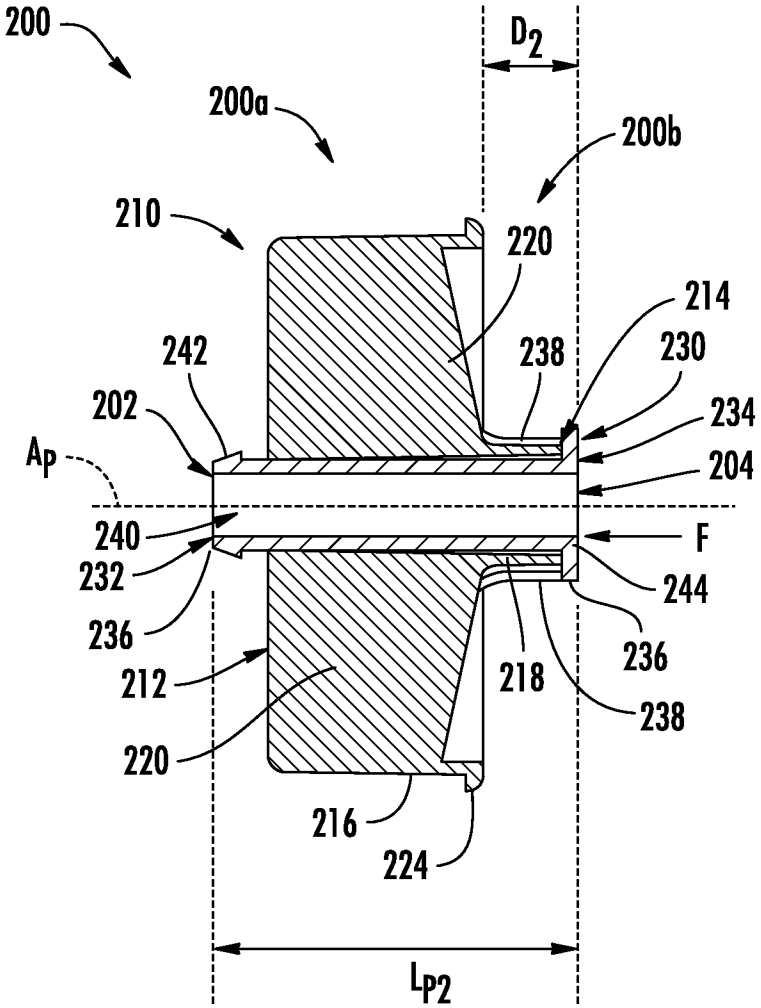
FIG. 2F is a cross-sectional top view of the core plug of FIG. 2A, taken along line 2F-2F of FIG. 2E, showing the support in the retracted position relative to the support.
Figure 2E:
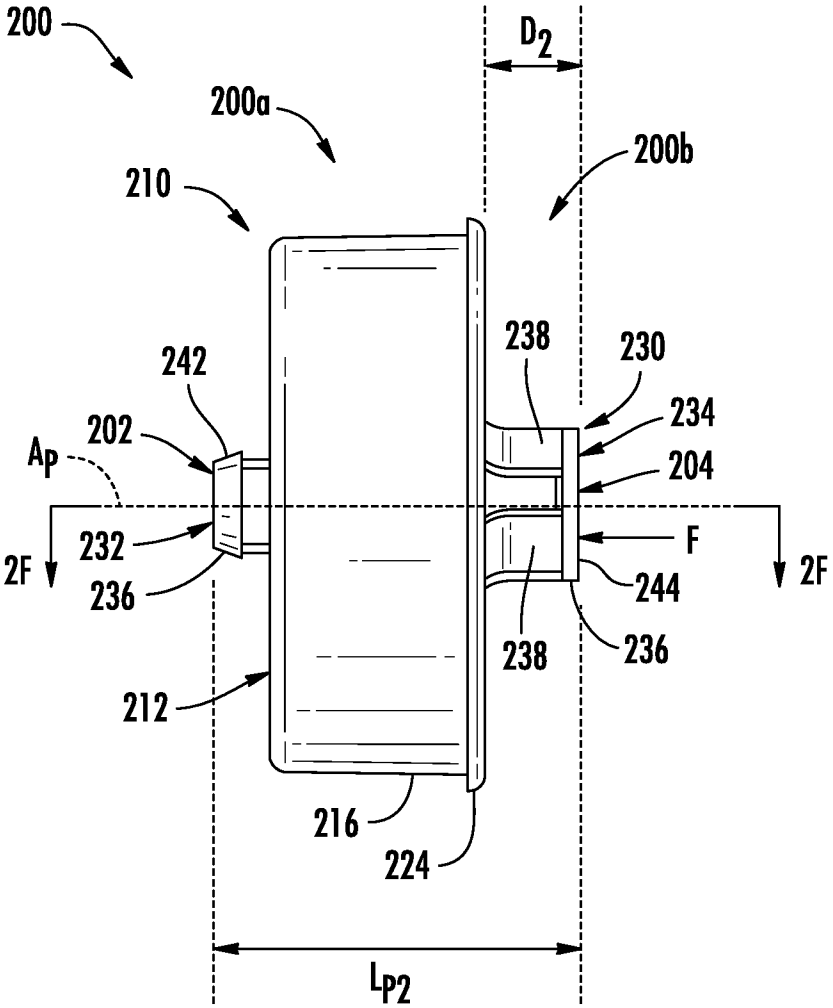
FIG. 2E is a side view of the core plug of FIG. 2A, showing the support in a retracted position relative to the shell.

As shown in FIGS. 2A-2F, the core plug 200 may have a first end 202 (which also may be referred to as an "inner end") and a second end 204 (which also may be referred to as an "outer end") positioned along a longitudinal axis $A_P$ of the core plug 200. During use of the core plug 200, the first end 202 may be positioned within the central opening of a roll, while the second end 204 is positioned outside of the central opening and spaced apart from the respective end of the roll. The core plug 200 may include a shell 210 (which also may be referred to as an "outer shell" or an "outer member") and a support 230 (which also may be referred to as an "inner support" or an "inner member"). As shown, the shell 210 and the support 230 may be separate components that are separately formed and assembled to one another. The support 230 may be positioned at least partially within the shell 210 and movable with respect to the shell 210. In particular, the support 230 may be configured to move between an extended position, as shown in FIGS. 2A, 2C, and 2D, and a retracted position, as shown in FIGS. 2E and 2F, with respect to the shell 210. Further details regarding the assembly of the shell 210 and the support 230 as well as the movement of the support 230 relative to the shell 210 are described below.

The shell 210 may have a first end 212 (which also may be referred to as an "inner end") and a second end 214 (which also may be referred to as an "outer end") positioned along a longitudinal axis of the shell 210. As shown, the shell 210 may include a collar 216 (which also may be referred to as an "outer cylinder"), a hub 218 (which also may be referred to as an "inner cylinder"), and a plurality of spokes 220 (which also may be referred to as "arms"). The hub 218 may be positioned at least partially within the collar 216 and spaced apart from the collar 216, and each of the spokes 220 may extend outward from the hub 218 to the collar 216. In certain embodiments, as shown, the hub 218 may be concentric with the collar 216 (i.e., the longitudinal axis of the hub 218 is coaxial with the longitudinal axis of the collar 216), and the spokes 220 may extend radially from the hub 218 to the collar 216 and be arranged in a circumferential array about the longitudinal axis of the shell 210. In this manner, the shell 210 may include a number of openings defined between adjacent spokes 220 and respective portions of the hub 218 and the collar 216. In certain embodiments, the collar 216, the hub 218, and the spokes 220 may be integrally formed with one another to form the shell 210. In other words, the collar 216, the hub 218, and the spokes 220 may be formed as a single component. In other embodiments, one or more of the collar 216, the hub 218, and the spokes 220 may be separately formed and fixedly (i.e., permanently) attached to one another to form the shell 210. In certain embodiments, the shell 210 may be formed of a plastic, for example by injection molding, although other suitable materials and methods of manufacture may be used. In other embodiments, the shell 210 may be formed of a metal, such as zinc, for example by die-casting, although other suitable materials and methods of manufacture may be used. In certain embodiments, the shell 210 may be rigid or substantially rigid, such that the collar 216, the hub 218, and the spokes 220 are inflexible and incompressible or are substantially inflexible and substantially incompressible in the direction of the longitudinal axis of the shell 210.

As shown, the collar 216 may have a generally cylindrical shape with a circular cross-sectional shape taken perpendicular to the longitudinal axis of the shell 210, although other suitable shapes of the collar 216 may be used. In certain embodiments, as shown, the collar 216 may extend from the first end 212 of the shell 210 and may be spaced apart from the second end 214 of the shell 210, although other positions of the collar 216 may be used. In certain embodiments, the collar 216 may have a constant or substantially constant outer diameter along a majority of or the entire axial length of the collar 216. In other embodiments, the collar 216 may have an outer diameter that decreases along a majority of or the entire axial length of the collar 216 in the direction from the second end 214 toward the first end 212 of the shell 210 to facilitate insertion of the shell 210 into the central opening of a roll of sheet product. As shown, the collar 216 may include a first lip 222 (which also may be referred to as an "inner lip") positioned near but spaced apart from the second end 214 of the shell 210, and a second lip 224 (which also may be referred to as an "outer lip") positioned at or near the second end 214 of the shell 210 and spaced apart from the first lip 222. The first lip 222 may extend radially inward toward the longitudinal axis of the shell 210 and may be configured to engage a portion of the support 230, as described below. The second lip 224 may extend radially outward away from the longitudinal axis of the shell 210 and may be configured to limit insertion of the shell 210, and thus the overall core plug 200, into the central opening of a roll of sheet product, as described below. In certain embodiments, as shown, each of the first lip 222 and the second lip 224 may be formed as a flange extending along the entire circumference of the collar 216. In other embodiments, one or both of the first lip 222 and the second lip 224 may extend along only a portion of the circumference of the collar 216.

The hub 218 also may have a generally cylindrical shape with a circular cross-sectional shape taken perpendicular to the longitudinal axis of the shell 210, although other suitable shapes of the hub 218 may be used. In certain embodiments, as shown, the hub 218 may extend from the first end 212 to the second end 214 of the shell 210, although other positions of the hub 218 may be used. The hub 218 may include a central opening 226 extending axially from a first end to a second end of the hub 218 and configured to receive a portion of the support 230 therein. In certain embodiments, as shown, the central opening 226 may have a generally cylindrical shape with a circular cross-sectional shape taken perpendicular to the longitudinal axis of the shell 210, although other suitable shapes of the central opening 226 may be used.

As shown, each of the spokes 220 may have a generally planar shape extending parallel or substantially parallel to the longitudinal axis of the shell 210, although other suitable shapes of the spokes 220 may be used. In certain embodiments, as shown, each of the spokes 220 may extend from the first end 212 of the shell 210 and may be spaced apart from the second end 212 of the shell 210, although other positions of the spokes 220 may be used. Each of the spokes 220 may be attached to the collar 216 and the hub 218, such that the collar 216 and the hub 218 are maintained in a concentric relationship. As shown, a number of openings, each extending from the first end 212 to the second end 214 of the shell 210, may be defined between each pair of adjacent spokes 220 and respective portions of the collar 216 and the hub 218. In certain embodiments, the spokes 220 may be arranged in a circumferential array about the longitudinal axis of the shell 210, although other arrangements of the spokes 220 may be used. Although the illustrated embodiment includes four spokes 220 that are equally spaced apart from one another in the circumferential direction, any number of spokes 220 and alternative spacings of the spokes 220 may be used.

During use of the core plug 200, a first portion 210*a* (which also may be referred to as an "inserted portion") of the shell 210 may be inserted into the central opening of a roll of sheet product, while a second portion 210*b* (which also may be referred to as an "exposed portion") of the shell 210 may be positioned outside of the central opening of the roll and extend outwardly from a respective end of the roll. In certain embodiments, the first portion 210*a* may include a portion of the collar 216, a portion of the hub 218, and a portion of each of the spokes 220, and the second portion 210*b* may include a portion of the collar 216, a portion of the hub 218, and a portion of each of the spokes 220. Alternative arrangements of the first portion 210*a* and the second portion 210*b* may be used.

The support 230 may have a first end 232 (which also may be referred to as an "inner end") and a second end 234 (which also may be referred to as an "outer end") positioned along a longitudinal axis of the support 230. As shown, the support 230 may include a body 236 (which also may be referred to as a "support body" or a "cylinder") and a plurality of arms 238 (which also may be referred to as "spring arms" or "wings"). Each of the arms 238 may extend outward from the body 236 and be arranged in a circumferential array about the longitudinal axis of the support 230. In certain embodiments, the body 236 and the arms 238 may be integrally formed with one another to form the support 230. In other words, the body 236 and the arms 238 may be formed as a single component. In other embodiments, the body 236 and the arms 238 may be separately formed and fixedly (i.e., permanently) attached to one another to form the support 230. In certain embodiments, the support 230 may be formed of a plastic, for example by injection molding, although other suitable materials and methods of manufacture may be used. In certain embodiments, a portion of the support 230 may be rigid or substantially rigid, and another portion of the support 230 may be flexible. In particular, the body 236 may be rigid or substantially rigid, such that the body 236 is inflexible and incompressible or is substantially inflexible and substantially incompressible in the direction of the longitudinal axis of the support 230, and the arms 238 may be flexible and/or compressible in the direction of the longitudinal axis of the support 230.

As shown, the body 236 may have a generally cylindrical shape with a circular cross-sectional shape taken perpendicular to the longitudinal axis of the support 230, although other suitable shapes of the body 236 may be used. In certain embodiments, as shown, the body 236 may extend from the first end 232 to the second end 234 of the support 230, although other positions of the body 236 may be used. In certain embodiments, the body 236 may have a constant or substantially constant outer diameter along a majority of or the entire axial length of the body 236. In other embodiments, the body 236 may have an outer diameter that varies along the axial length of the body 236. In certain embodiments, as shown, the body 236 may be hollow, such that the body 236 includes a central opening 240 defined therein. The central opening 240 may extend along the longitudinal axis of the support 230. In certain embodiments, as shown, the central opening 240 may extend entirely through the body 236, such that both ends of the body 236 are open. In other embodiments, the body 236 may have an open end and a closed end. In certain embodiments, the body 236 may include a first lip 242 (which also may be referred to as an "outer lip") positioned near but spaced apart from the first end 232 of the support 230, and a second lip 244 (which also may be referred to as an "outer lip") positioned at or near the second end 234 of the support 230. The first lip 242 may extend radially outward away from the longitudinal axis of the support 230 and may be configured to engage a portion of the shell 210, as described below. The second lip 244 may extend radially outward away from the longitudinal axis of the support 230 and may be configured to engage a portion of the shell 210, as described below. In certain embodiments, as shown, each of the first lip 242 and the second lip 244 may be formed as a flange extending along the entire circumference of the body 236. In other embodiments, one or both of the first lip 242 and the second lip 244 may extend along only a portion of the circumference of the body 236.

Each of the arms 238 may have a contoured shape extending radially outward from the body 236 and axially along the body 236 toward the first end 232 of the support 230, although other suitable shapes of the arms 238 may be used. In certain embodiments, at least a portion of each of the arms 238 may be curved to extend radially outward away from the body 236. In other embodiments, each of the arms 238 may have a generally planar shape and may be angled at an acute angle relative to the longitudinal axis of the support 230, such that the arms 238 extend radially outward from the body 236 and axially along the body 236 toward the first end 232 of the support 230. Each of the arms 238 may be attached to the body 236 and arranged in a circumferential array about the longitudinal axis of the support 230, although other arrangements of the arms 238 may be used. Although the illustrated embodiment includes four arms 238 that are equally spaced apart from one another in the circumferential direction, any number of arms 238 and alternative spacings of the arms 238 may be used. The arms 238 may be resiliently flexible such that the arms 238 may be elastically deflected (i.e., deformed) relative to the body 236 toward the second end 234 of the support 230 upon application of an external force and then return to their original position upon removal of such force.

During use of the core plug 200, a first portion 230*a* (which also may be referred to as an "inserted portion") of the support 230 may be inserted into the central opening of a roll of sheet product, while a second portion 230*b* (which also may be referred to as an "exposed portion") of the support 230 may be positioned outside of the central opening of the roll and extend outwardly from a respective end of the roll. In certain embodiments, the first portion 230*a* may include a portion of the body 236 and a portion of each of the arms 238, and the second portion 230*b* may include a portion of the body 236 and a portion of each of the arms 238. Alternative arrangements of the first portion 230*a* and the second portion 230*b* may be used.

As shown, the support 230 may be movably attached to the shell 210 to form the core plug 200. The core plug 200 may be assembled by inserting the body 236 of the support 230 through the central opening 226 of the hub 218 of the shell 210 and axially advancing the support 230 relative to the shell 210 until the first lip 242 of the body 236 has passed through the hub 218 of the shell 210. As the first lip 242 is inserted into the central opening 226 of the hub 218, the first lip 242 may elastically deflect radially inward toward the longitudinal axis of the support 230. Once the first lip 242 has passed through the hub 218 of the shell 210, the first lip 242 may return to its original position relative to the body 236 and engage the end of the hub 218, as shown in FIG. 2D. Additionally, once the first lip 242 of the body 236 has passed through the hub 218 of the shell 210, the arms 238 may engage the first lip 222 of the collar 216, as shown.

Upon assembly of the core plug 200, the support 230 may be movably retained by the shell 210. As shown, the body 236 of the support 230 may be positioned within the central opening 226 of the hub 218 of the shell 210, and respective free ends of the arms 238 may be positioned within the collar 216, which may limit lateral movement of the support 230 relative to the shell 210. Additionally, contact between the hub 218 and the second lip 244 of the body 236 and/or contact between the first lip 222 of the collar 216 and the arms 238 of the support 230 may limit axial movement of the support 230 relative to the shell 210 in a first direction, and contact between the hub 218 and the first lip 242 of the body 236 may limit axial movement of the support 230 relative to the shell 210 in an opposite second direction.

As described above, the support 230 may be configured to move relative to the shell 210 between an extended position, as shown in FIGS. 2A, 2C, and 2D, and a retracted position, as shown in FIGS. 2E and 2F. In particular, a portion of the support 230, such as the body 236, may be configured to translate relative to the shell 210 upon application of an external axial force F to the body 236 while the position of the shell 210 is maintained. Upon application of the external axial force F, the arms 238 of the support 230 may contact the first lip 222 of the collar 216 and elastically deflect (i.e., deform) relative to the body 236 toward the second end 234 of the support 230 while the body 236 translates relative to the hub 218. Upon removal of the external axial force F, the arms 238 may spring back and return to their original position relative to the body 236, thereby biasing the body 236 to translate relative to the hub 218. When the support 230 is in the extended position, the core plug 200 may have a first axial length $L_{P1}$ and the support 230 may extend beyond the collar 216 of the shell 210 by a first axial distance $D_1$. When the support 230 is in the retracted position, the core plug 200 may have a second axial length $L_{P2}$ and the support 230 may extend beyond the collar 216 of the shell 210 by a second axial distance $D_2$. As shown, the second axial length $L_{P2}$ may be equal to the first axial length $L_{P1}$, and the second axial distance $D_2$ may be less than the first axial distance $D_1$.

During use of the core plug 200, a first portion 200*a* (which also may be referred to as an "inserted portion") of the core plug 200 may be inserted into the central opening of a roll of sheet product, while a second portion 200*b* (which also may be referred to as an "exposed portion") of the core plug 200 may be positioned outside of the central opening of the roll and extend outwardly from a respective end of the roll. The first portion 200*a* of the core plug 200 may include the first portion 210*a* of the shell 210 and the first portion 230*a* of the support 230, and the second portion 200*b* of the core plug 200 may include the second portion 210*b* of the shell 210 and the second portion 230*b* of the support 230.

Figure 2G:
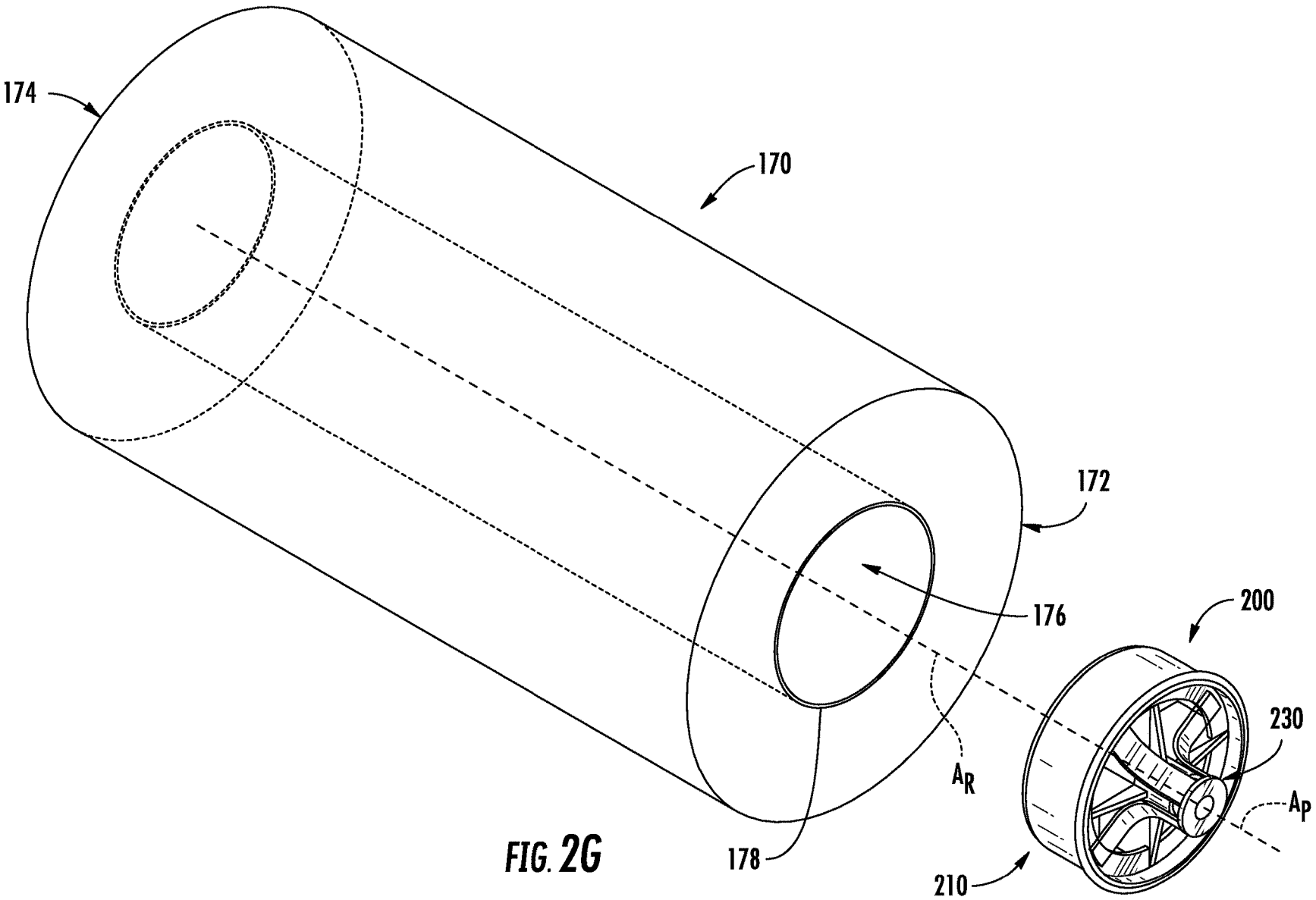
FIG. 2G is a perspective view of the core plug of FIG. 2A and a roll of sheet product.
Figure 2H:
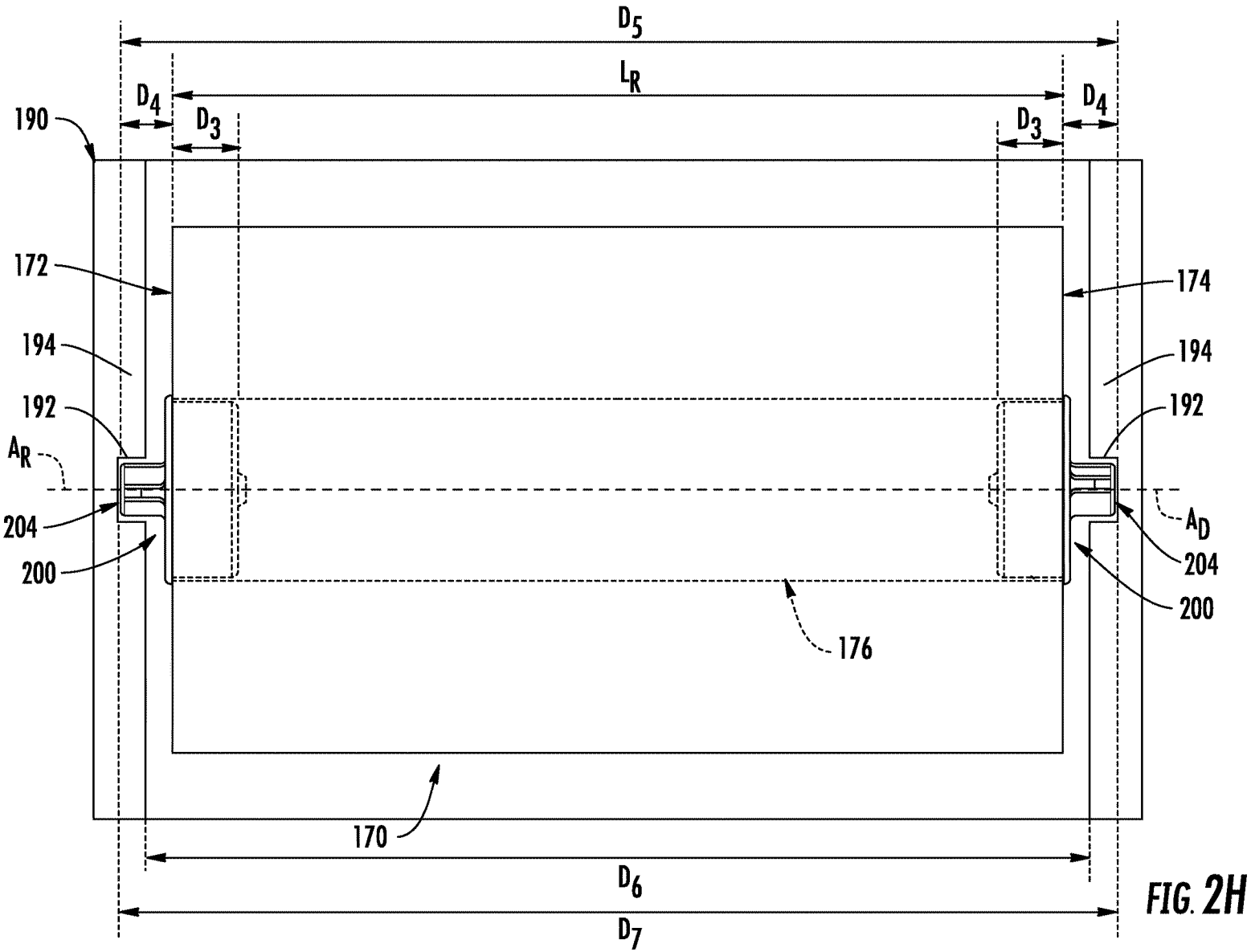
FIG. 2H is a plan view of the roll of sheet product supported with respect to a sheet product dispenser by two of the core plugs of FIG. 2A.

FIGS. 2G and 2H illustrate use of the core plug 200 to support a roll 170 of sheet product with respect to a sheet product dispenser 190. The roll 170 of sheet product and the sheet product dispenser 190 may be configured in the manner described above. The core plug 200 may be attached to the roll 170 of sheet product by inserting the first portion 200*a* of the core plug 200 into the central opening 176 at one of the ends 172, 174 of the roll 170. The collar 216 of the shell 210 may be secured within the central opening 176 by a press-fit and/or an adhesive may be applied to interfaces of the collar 216 and the central opening 176 to secure the core plug 200 to the roll 170. The second lip 224 of the collar 216 may limit insertion of the core plug 200 into the central opening 176 and indicate full insertion of the core plug 200 has been achieved when the second lip 224 contacts the respective end 172, 174 of the roll 170. When the core plug 200 is attached to the roll 170, the first portion 200*a* of the core plug 200 is received within the central opening 176, and the second portion 200*b* of the core plug 200 is positioned outside of the central opening 176 and extends outward from the respective end 172, 174 of the roll 170. As shown, the first portion 200*a* may be inserted within the central opening 176 along an axial distance $D_3$, and the second portion 200*b* may extend beyond the respective end 172, 174 of the roll 170 by an axial distance $D_4$. Two separate core plugs 200 may be attached to the roll 170 in this manner, as shown in FIG. 2H, to form a roll-and-core-plug assembly. With both core plugs 200 attached to the roll 170, the opposite second ends 204 of the core plugs 200 (i.e., the ends of the bodies 236 of the core plugs 200) may be spaced apart from one another by an axial distance $D_5$.

The roll 170 of sheet product, with the core plugs 200 attached thereto, may be loaded into the sheet product dispenser 190 by inserting the bodies 236 of the supports 230 of the core plugs 200 into the respective support features 192, as shown in FIG. 2H. The method of inserting the bodies 236 into the respective support features 192 may vary, depending on the configuration of the support features 192 and the overall dispenser 190. In certain embodiments, the bodies 236 may be slid into or otherwise inserted into the support features 192 while the supports 230 are in the extended position, for example, when the support features 192 are slots or channels having an open end for initial insertion. In other embodiments, the supports 230 may be moved from the extended position to or toward the retracted position while the bodies 236 are positioned with respect to the support features 192, at which point the supports 230 may be allowed to return to or toward the extended position and engage the support features 192. Such movement of the supports 230 relative to the shells 210 may be performed by a user or may be facilitated by mating features of the dispenser 190 as a user loads the roll 170 therein. Upon insertion, the bodies 236 may be rotatably received within the respective support features 192 such that the roll 170 is able to rotate with respect to the dispenser 190 for dispensing sheet product therefrom.

As noted above, the axially adjustable nature of the core plugs 200 may reduce incidence of under-engagement or over-engagement between the core plugs 200 and the respective support features 192, even when certain variations exist. For example, when the axial length $L_R$ of the roll 170 of sheet product is less than intended, the supports 230 of the core plugs 200 may assume the extended position such that the axial distance $D_5$ is greater than the axial distance $D_6$. Additionally, when the axial length $L_R$ of the roll 170 of sheet product is greater than intended, the supports 230 of the core plugs 200 may assume a retracted position such that the axial distance $D_5$ is equal to or less than the axial distance $D_7$. As another example, when the axial distance $D_6$ between the walls 194 is greater than intended and/or the axial distance $D_7$ between the ends of the support features 192 is greater than intended, the supports 230 of the core plugs 200 may assume the extended position such that the axial distance $D_5$ is greater than the axial distance $D_6$. Additionally, when the axial distance $D_6$ between the walls 194 is less than intended and/or the axial distance $D_7$ between the ends of the support features 192 is less than intended, the supports 230 of the core plugs 200 may assume a retracted position such that the axial distance $D_5$ is equal to or less than the axial distance $D_7$. As still another example, when the axial distance $D_3$ along which one or both of the core plugs 200 is inserted into the central aperture 176 of the roll 170 is less than intended (i.e., one or both of the core plugs 200 is not fully inserted), the supports 230 of the core plugs 200 may assume a retracted position such that the axial distance $D_5$ is equal to or less than the axial distance $D_7$. In this manner, the core plugs 200 may facilitate desired engagement between the core plugs 200 and the support features 192 and prevent, or at least reduce the likelihood of, the problems associated with under-engagement and over-engagement.

FIGS. 3A-3F illustrate a core plug 300 (which also may be referred to as a "sheet product roll core plug" or simply a "plug") according to one or more embodiments of the disclosure. The core plug 300 is configured to support a roll of sheet product with respect to a sheet product dispenser, as described below. In particular, the core plug 300 may be configured to be partially inserted into a central opening of the roll of sheet product and to engage one or more mating support features of the sheet product dispenser such that the roll is able to rotate with respect to the dispenser for dispensing sheet product therefrom. As described below, the core plug 300 is axially adjustable, which may allow the core plug 300 to accommodate variations in the axial length of rolls of sheet product, variations in the distance between a pair of opposing support features of a dispenser, and/or variations in the axial distances along which the core plugs 300 are inserted into the central opening of a roll, thereby reducing incidence of under-engagement or over-engagement between the core plugs 300 and respective support features of the dispenser.

Figure 3B:
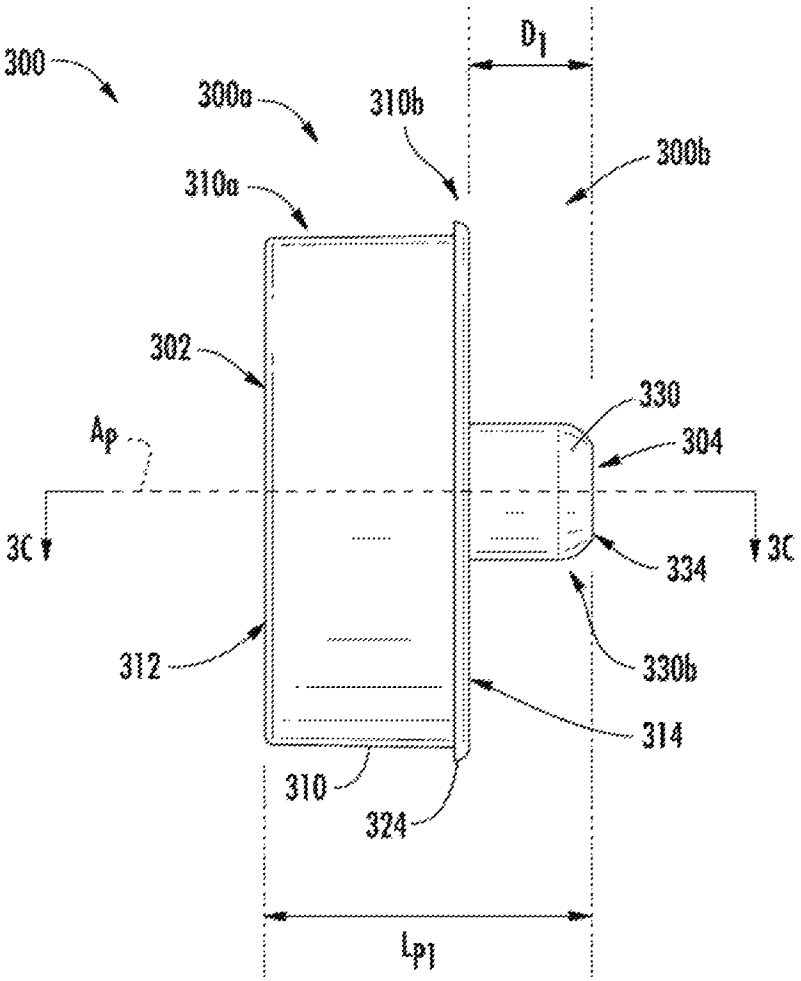
FIG. 3B is a side view of the core plug of FIG. 3A, showing the support in an extended position relative to the support.
Figure 3A:
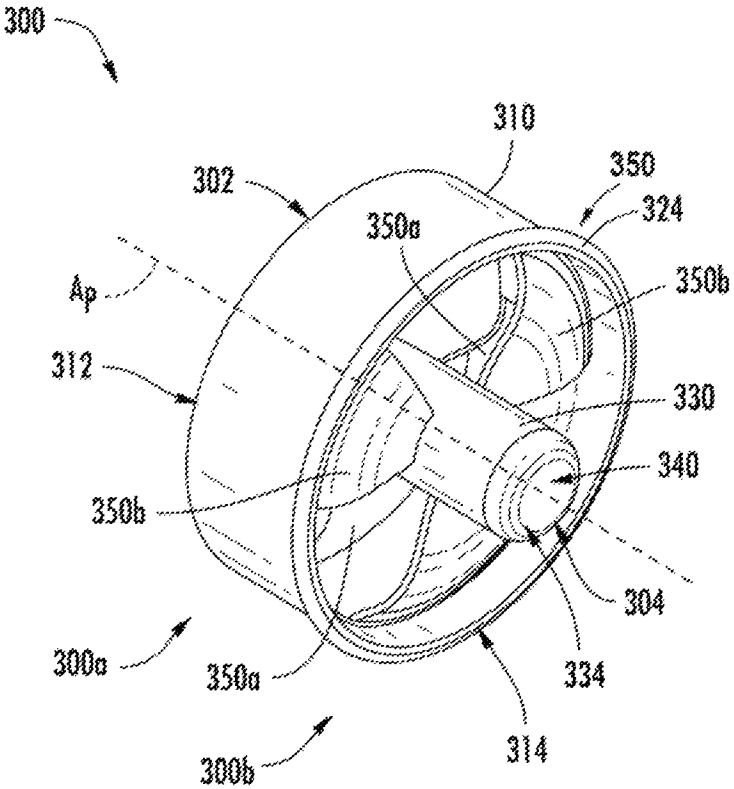
FIG. 3A is a perspective view of a core plug in accordance with one or more embodiments of the disclosure, showing a shell, a support, and arms of the core plug.
Figure 3D:
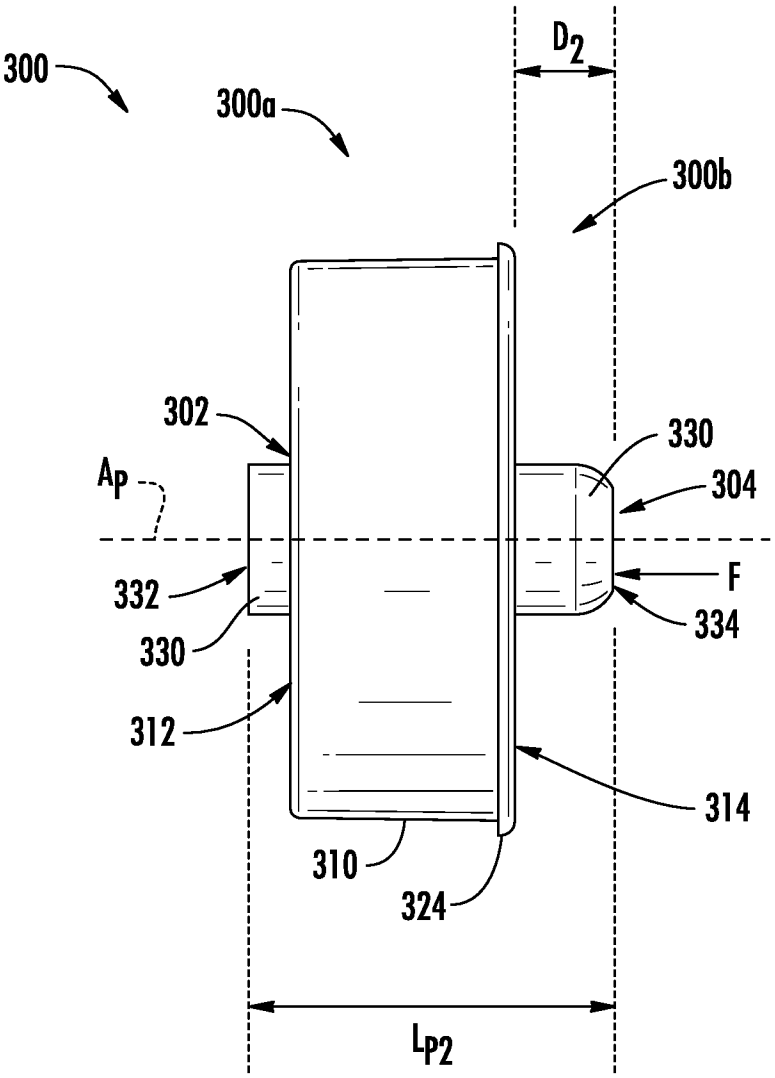
FIG. 3D is a side view of the core plug of FIG. 3A, showing the support in a retracted position relative to the support.
Figure 3C:
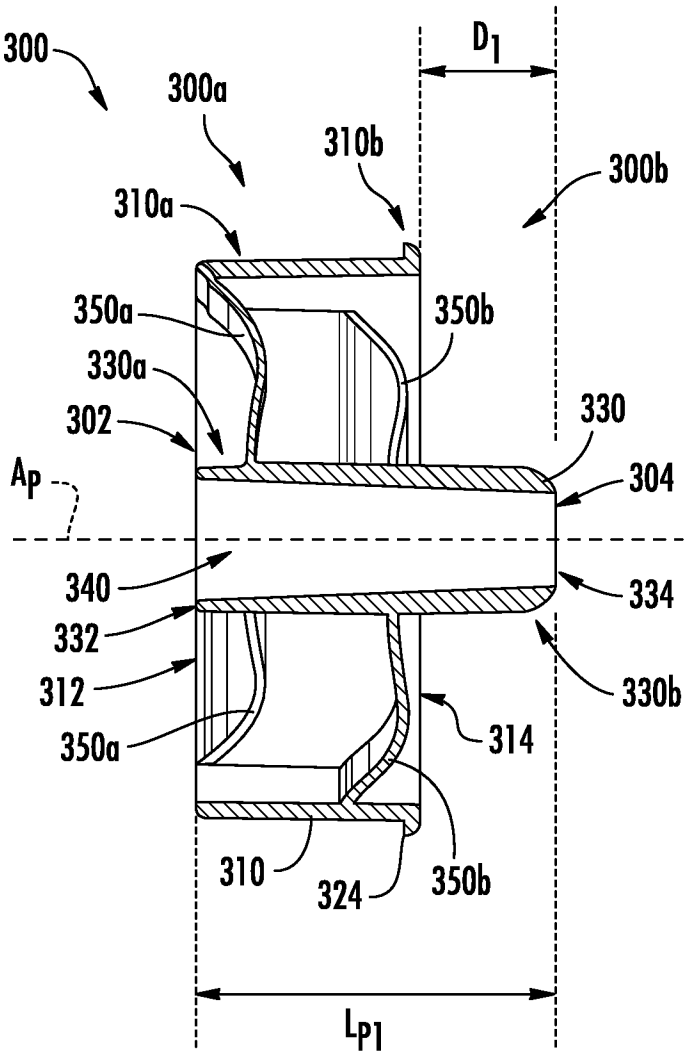
FIG. 3C is a cross-sectional top view of the core plug of FIG. 3A, taken along line 3C-3C of FIG. 3B, showing the support in the extended position relative to the shell.

As shown in FIGS. 3A-3D, the core plug 300 may have a first end 302 (which also may be referred to as an "inner end") and a second end 304 (which also may be referred to as an "outer end") positioned along a longitudinal axis $A_P$ of the core plug 300. During use of the core plug 300, the first end 302 may be positioned within the central opening of a roll, while the second end 304 is positioned outside of the central opening and spaced apart from the respective end of the roll. The core plug 300 may include a shell 310 (which also may be referred to as an "outer shell," an "outer member," an "outer cylinder," a "collar," or an "outer collar"), a support 330 (which also may be referred to as an "inner support," an "inner member," an "inner cylinder," a "hub," or an "inner hub"), and a plurality of arms 350 (which also may be referred to as "spring arms," "wings," or "spokes"). In certain embodiments, as shown, the shell 310, the support 330, and the arms 350 may be integrally formed with one another to form the core plug 300. In other words, the shell 310, the support 330, and the arms 350 may be formed as a single component. In other embodiments, one or more of the shell 310, the support 330, and the arms 350 may be separately formed and fixedly (i.e., permanently) attached to one another to form the core plug 300. In certain embodiments, the core plug 300 may be formed of a plastic, for example by injection molding, although other suitable materials and methods of manufacture may be used. In certain embodiments, one or more portions of the core plug 300 may be rigid or substantially rigid, and one or more other portions of the core plug 300 may be flexible. In particular, the shell 310 and the support 330 may be rigid or substantially rigid, such that the shell 310 and the support 330 are inflexible and incompressible or are substantially inflexible and substantially incompressible in the direction of the longitudinal axis $A_P$ of the core plug 300, and the arms 350 may be flexible and/or compressible in the direction of the longitudinal axis $A_P$ of the core plug 300. The support 330 may be positioned at least partially within the shell 310 and movable with respect to the shell 310. In particular, the support 330 may be configured to move between an extended position, as shown in FIGS. 3A-3C, and a retracted position, as shown in FIG. 3D, with respect to the shell 310. Further details regarding the movement of the support 330 relative to the shell 310 are described below.

The shell 310 may have a first end 312 (which also may be referred to as an "inner end") and a second end 314

(which also may be referred to as an "outer end") positioned along a longitudinal axis of the shell 310. As shown, the shell 310 may have a generally cylindrical shape with a circular cross-sectional shape taken perpendicular to the longitudinal axis of the shell 310, although other suitable shapes of the shell 310 may be used. In certain embodiments, as shown, the shell 310 may extend from the first end 302 of the core plug 300 and may be spaced apart from the second end 304 of the core plug 300, although other positions of the shell 310 may be used. In certain embodiments, the shell 310 may have a constant or substantially constant outer diameter along a majority of or the entire axial length of the shell 310. In other embodiments, the shell 310 may have an outer diameter that decreases along a majority of or the entire axial length of the shell 310 in the direction from the second end 314 toward the first end 312 of the shell 310 to facilitate insertion of the shell 310 into the central opening of a roll of sheet product. As shown, the shell 310 may include a lip 324 (which also may be referred to as an "outer lip") positioned at or near the second end 314 of the shell 310 and spaced apart from the second end 304 of the core plug 300. The lip 324 may extend radially outward away from the longitudinal axis of the shell 310 and may be configured to limit insertion of the shell 310, and thus the overall core plug 300, into the central opening of a roll of sheet product, as described below. In certain embodiments, as shown, the lip 324 may be formed as a flange extending along the entire circumference of the shell 310. In other embodiments, the lip 324 may extend along only a portion of the circumference of the shell 310. During use of the core plug 300, a first portion 310*a* (which also may be referred to as an "inserted portion") of the shell 310 may be inserted into the central opening of a roll of sheet product, while a second portion 310*b* (which also may be referred to as an "exposed portion") of the shell 310 may be positioned outside of the central opening of the roll and extend outwardly from a respective end of the roll.

The support 330 may have a first end 332 (which also may be referred to as an "inner end") and a second end 334 (which also may be referred to as an "outer end") positioned along a longitudinal axis of the support 330. As shown, the support 330 may have a generally cylindrical shape with a circular cross-sectional shape taken perpendicular to the longitudinal axis of the support 330, although other suitable shapes of the support 330 may be used. In certain embodiments, as shown, the support 330 may extend from the first end 302 to the second end 304 of the core plug 300, although other positions of the support 330 may be used. In certain embodiments, the support 330 may have a constant or substantially constant outer diameter along a majority of or the entire axial length of the support 330. In other embodiments, the support 330 may have an outer diameter that varies along the axial length of the support 330. In certain embodiments, as shown, the support 330 may be hollow, such that the support 330 includes a central opening 340 defined therein. The central opening 340 may extend along the longitudinal axis of the support 330. In certain embodiments, as shown, the central opening 340 may extend entirely through the support 330, such that both ends 332, 334 of the support 330 are open. In other embodiments, one of the ends 332, 334 of the support 330 may be open end and the other of the ends 332, 334 may be closed. As shown, the support 330 may be positioned at least partially within the shell 310 and spaced apart from the shell 310, and each of the arms 350 may extend outward from the support 330 to the shell 310. During use of the core plug 300, a first portion 330*a* (which also may be referred to as an "inserted portion") of the support 330 may be inserted into the central opening of a roll of sheet product, while a second portion 330*b* (which also may be referred to as an "exposed portion") of the support 330 may be positioned outside of the central opening of the roll and extend outwardly from a respective end of the roll.

Each of the arms 350 may have a contoured shape extending radially outward from the support 330 to the shell 310 and axially along the support 330 toward the first end 302 of the core plug 300, although other suitable shapes of the arms 350 may be used. In certain embodiments, at least a portion of each of the arms 350 may be curved to extend radially outward away from the support 330 and axially along the support 330. In other embodiments, each of the arms 350 may have a generally planar shape and may be angled at an acute angle relative to the longitudinal axis of the support 330, such that the arms 350 extend radially outward from the support 330 and axially along the support 330 toward the first end 302 of the core plug 300. Each of the arms 350 may be attached to the support 330 and the shell 310, such that the shell 310 and the support 330 are maintained in a concentric relationship. The arms 350 may be arranged in a circumferential array about the longitudinal axis $A_P$ of the core plug 300, although other arrangements of the arms 350 may be used. As shown, a number of openings may be defined between each pair of adjacent arms 350 and respective portions of the shell 310 and the support 330.

The arms 350 may include a plurality of first arms 350*a* positioned closer to the first end 302 of the core plug 300, and a plurality of second arms 350*b* axially spaced apart from the first arms 350*a* and first positioned closer to the second end 304 of the core plug 300. The first arms 350*a* may be arranged in a first circumferential array about the longitudinal axis $A_P$ of the core plug 300, and the second arms 350*b* may be arranged in a second circumferential array about the longitudinal axis $A_P$ of the core plug 300. In certain embodiments, as shown, the first arms 350*a* may be at least partially offset from the second arms 350*b* in the circumferential direction with respect to the longitudinal axis $A_P$ of the core plug 300, although portions of the first arms 350*a* and the second arms 350*b* may partially overlap one another in the circumferential direction. In other embodiments, the first arms 350*a* may be entirely offset from the second arms 350*b* in the circumferential direction. In still other embodiments, the first arms 350*a* may be aligned with the second arms 350*b* in the circumferential direction. In certain embodiments, the shape of the first arms 350*a* may be the same as the shape of the second arms 350*b*. In other embodiments, the shape of the first arms 350*a* may be different than the shape of the second arms 350*b*. Although the illustrated embodiment includes three first arms 350*a* that are equally spaced apart from one another in the circumferential direction and three second arms 350*b* that are equally spaced apart from one another in the circumferential direction, any number of the first arms 350*a* and the second arms 350*b* and alternative spacings of the arms 350*a*, 350*b* may be used. In certain embodiments, the first arms 350*a* or the second arms 350*b* may be omitted. The arms 350*a*, 350*b* may be resiliently flexible such that the arms 350*a*, 350*b* may be elastically deflected (i.e., deformed) relative to the support 330 and the shell 310 upon application of an external force and then return to their original position upon removal of such force.

As described above, the support 330 may be configured to move relative to the shell 310 between an extended position, as shown in FIGS. 3A-3C, and a retracted position, as shown in FIG. 3D. In particular, the support 330 may be configured to translate relative to the shell 310 upon application of an external axial force F to the support 330 while the position of the shell 310 is maintained. Upon application of the external axial force F, the arms 350 may elastically deflect (i.e., deform) relative to the support 330 and the shell 310 while the support 330 translates relative to the shell 310. Upon removal of the external axial force F, the arms 350 may spring back and return to their original position relative to the support 330 and the shell 310, thereby biasing the support 330 to translate relative to the shell 310. When the support 330 is in the extended position, the core plug 300 may have a first axial length $L_{P1}$ and the support 330 may extend beyond the shell 310 by a first axial distance $D_1$. When the support 330 is in the retracted position, the core plug 300 may have a second axial length $L_{P2}$ and the support 330 may extend beyond the shell 310 by a second axial distance $D_2$. In certain embodiments, as shown, the second axial length $L_{P2}$ may be equal to the first axial length $L_{P1}$, and the second axial distance $D_2$ may be less than the first axial distance $D_1$. In other embodiments, the second axial length $L_{P2}$ may be less than the first axial length $L_{P1}$, and the second axial distance $D_2$ may be less than the first axial distance $D_1$.

During use of the core plug 300, a first portion 300*a* (which also may be referred to as an "inserted portion") of the core plug 300 may be inserted into the central opening of a roll of sheet product, while a second portion 300*b* (which also may be referred to as an "exposed portion") of the core plug 300 may be positioned outside of the central opening of the roll and extend outwardly from a respective end of the roll. In certain embodiments, as shown, the first portion 300*a* of the core plug 300 may include the first portion 310*a* of the shell 310, the first portion 330*a* of the support 330, and the entirety of each of the arms 350, and the second portion 300*b* of the core plug 300 may include the second portion 310*b* of the shell 310 and the second portion 330*b* of the support 330. In other embodiments, the first portion 300*a* of the core plug 300 may include the first portion 310*a* of the shell 310, the first portion 330*a* of the support 330, and a portion of one or more of the arms 350, and the second portion 300*b* of the core plug 300 may include the second portion 310*b* of the shell 310, the second portion 330*b* of the support 330, and a portion of one or more of the arms 350.

Figure 3E:
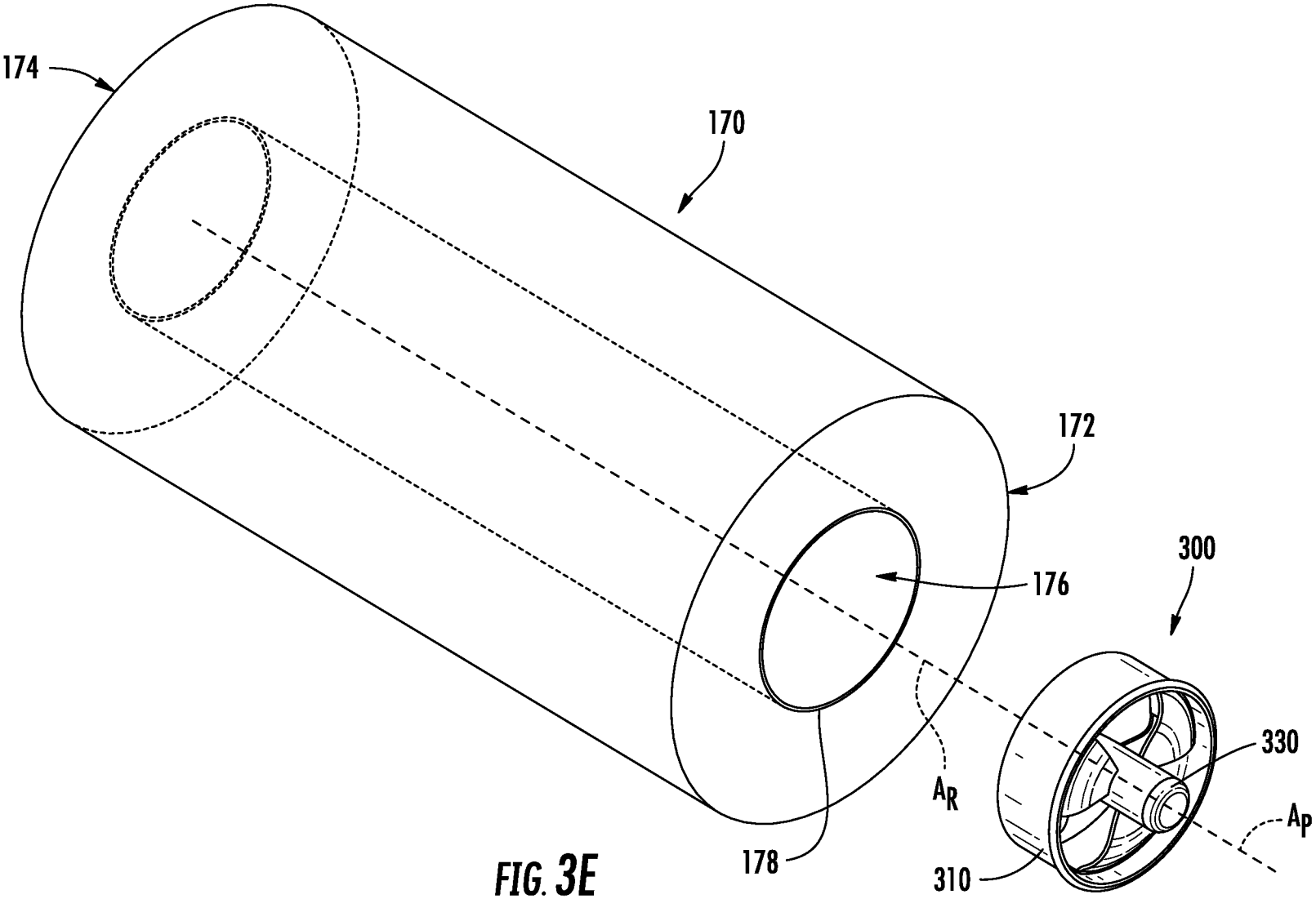
FIG. 3E is a perspective view of the core plug of FIG. 3A and a roll of sheet product.
Figure 3F:
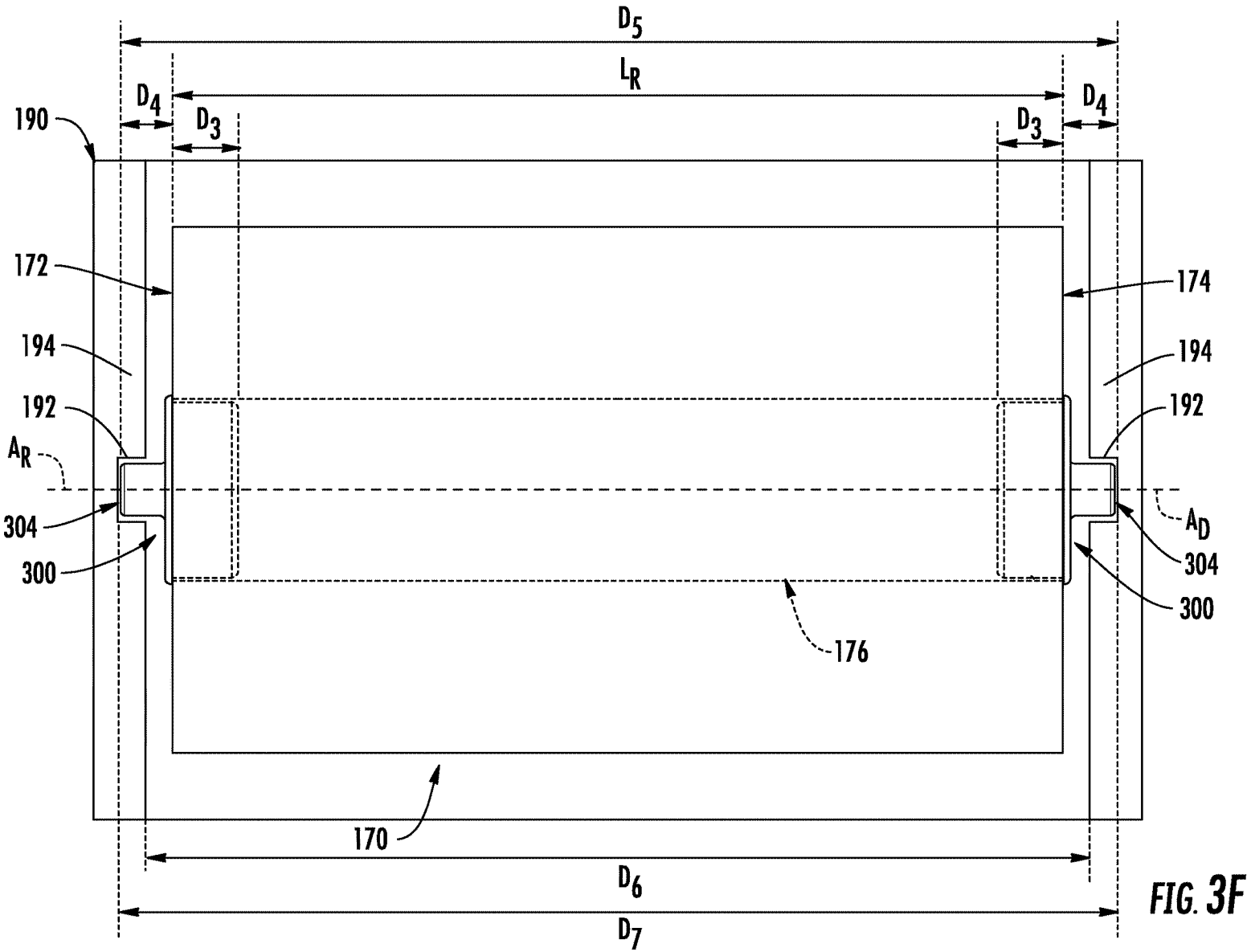
FIG. 3F is a plan view of the roll of sheet product supported with respect to a sheet product dispenser by two of the core plugs of FIG. 3A.

FIGS. 3E and 3F illustrate use of the core plug 300 to support a roll 170 of sheet product with respect to a sheet product dispenser 190. The roll 170 of sheet product and the sheet product dispenser 190 may be configured in the manner described above. The core plug 300 may be attached to the roll 170 of sheet product by inserting the first portion 300*a* of the core plug 300 into the central opening 176 at one of the ends 172, 174 of the roll 170. The shell 310 may be secured within the central opening 176 by a press-fit and/or an adhesive may be applied to interfaces of the shell 310 and the central opening 176 to secure the core plug 300 to the roll 170. The lip 324 of the shell 310 may limit insertion of the core plug 300 into the central opening 176 and indicate full insertion of the core plug 300 has been achieved when the lip 324 contacts the respective end 172, 174 of the roll 170. When the core plug 300 is attached to the roll 170, the first portion 300*a* of the core plug 300 is received within the central opening 176, and the second portion 300*b* of the core plug 300 is positioned outside of the central opening 176 and extends outward from the respective end 172, 174 of the roll 170. As shown, the first portion 300*a* may be inserted within the central opening 176 along an axial distance $D_3$, and the second portion 300*b* may extend beyond the respective end 172, 174 of the roll 170 by an axial distance $D_4$. Two separate core plugs 300 may be attached to the roll 170 in this manner, as shown in FIG. 3F, to form a roll-and-core-plug assembly. With both core plugs 300 attached to the roll 170, the opposite second ends 304 of the core plugs 300 (i.e., the second ends 334 of the supports 330 of the core plugs 300) may be spaced apart from one another by an axial distance $D_5$.

The roll 170 of sheet product, with the core plugs 300 attached thereto, may be loaded into the sheet product dispenser 190 by inserting the supports 330 of the core plugs 300 into the respective support features 192, as shown in FIG. 3F. The method of inserting the supports 330 into the respective support features 192 may vary, depending on the configuration of the support features 192 and the overall dispenser 190. In certain embodiments, the supports 330 may be slid into or otherwise inserted into the support features 192 while the supports 330 are in the extended position, for example, when the support features 192 are slots or channels having an open end for initial insertion. In other embodiments, the supports 330 may be moved from the extended position to or toward the retracted position while the supports 330 are positioned with respect to the support features 192, at which point the supports 330 may be allowed to return to or toward the extended position and engage the support features 192. Such movement of the supports 330 relative to the shells 310 may be performed by a user or may be facilitated by mating features of the dispenser 190 as a user loads the roll 170 therein. Upon insertion, the supports 330 may be rotatably received within the respective support features 192 such that the roll 170 is able to rotate with respect to the dispenser 190 for dispensing sheet product therefrom.

As noted above, the axially adjustable nature of the core plugs 300 may reduce incidence of under-engagement or over-engagement between the core plugs 300 and the respective support features 192, even when certain variations exist. For example, when the axial length $L_R$ of the roll 170 of sheet product is less than intended, the supports 330 of the core plugs 300 may assume the extended position such that the axial distance $D_5$ is greater than the axial distance $D_6$. Additionally, when the axial length $L_R$ of the roll 170 of sheet product is greater than intended, the supports 330 of the core plugs 300 may assume a retracted position such that the axial distance $D_5$ is equal to or less than the axial distance $D_7$. As another example, when the axial distance $D_6$ between the walls 194 is greater than intended and/or the axial distance $D_7$ between the ends of the support features 192 is greater than intended, the supports 330 of the core plugs 300 may assume the extended position such that the axial distance $D_5$ is greater than the axial distance $D_6$. Additionally, when the axial distance $D_6$ between the walls 194 is less than intended and/or the axial distance $D_7$ between the ends of the support features 192 is less than intended, the supports 330 of the core plugs 300 may assume a retracted position such that the axial distance $D_5$ is equal to or less than the axial distance $D_7$. As still another example, when the axial distance $D_3$ along which one or both of the core plugs 300 is inserted into the central aperture 176 of the roll 170 is less than intended (i.e., one or both of the core plugs 300 is not fully inserted), the supports 330 of the core plugs 300 may assume a retracted position such that the axial distance $D_5$ is equal to or less than the axial distance $D_7$. In this manner, the core plugs 300 may facilitate desired engagement between the core plugs 300 and the support features 192 and prevent, or at least reduce the likelihood of, the problems associated with under-engagement and over-engagement.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific core plug configurations, it will be appreciated that numerous other core plug configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A core plug for supporting a roll of sheet product, the core plug comprising:

a shell that is configured to be at least partially inserted into an opening of the roll of sheet product, the shell comprising:

a collar;

a cylindrical hub; and a plurality of spokes extending from the cylindrical hub to the collar; and a support removably coupled to the shell, the support comprising a body, a first arm, and a second arm, wherein at least the first arm contacts the collar during rotation of the roll of sheet product;

wherein the support is configured to move relative to the shell from a first position within the shell to a second position outside of the shell.

2. The core plug of claim 1, wherein the at least a portion of the support is configured to translate relative to the shell between the second position in which the support extends a first axial distance beyond the shell and a third position in which the support extends a second axial distance beyond the shell, and wherein the second axial distance is less than the first axial distance.

3. The core plug of claim 2, wherein the shell and the support are separately formed and movably attached to one another.

4. The core plug of claim 1, wherein the body of the support is configured to translate relative to the shell.

5. The core plug of claim 4, wherein the first arm and the second arm are configured to deflect when the body of the support is translated from the second position toward the first position, and wherein the first arm and the second arm of the support are configured to bias the body of the support toward the second position.

6. The core plug of claim 1, wherein the collar of the shell comprises a first lip, and wherein at least one of the first arm or the second arm engage the first lip of the shell.

7. The core plug of claim 6, wherein the collar of the shell further comprises a second lip configured to limit insertion of the shell into the opening of the roll of sheet product.

8. The core plug of claim 1, wherein the cylindrical hub of the shell comprises a central opening defined therein, and wherein at least a portion of the body is movably received within the central opening of the cylindrical hub.

9. The core plug of claim 1, wherein the collar, the cylindrical hub, and the plurality of spokes of the shell are integrally formed with one another, and wherein the body, the first arm, and the second arm are integrally formed with one another.

10. The core plug of claim 1, wherein the collar of the shell and the body of the support each have a cylindrical shape.

11. The core plug of claim 1, wherein the entire support is configured to translate relative to the shell between the second position and the first position.

12. The core plug of claim 11, wherein the first arm and the second arm are configured to deflect when the support is translated from the second position toward the first position, and wherein the first arm and the second arm are configured to bias the support toward the second position.

13. The core plug of claim 11, wherein the shell and the support each have a cylindrical shape.

14. The core plug of claim 11, wherein the shell comprises a lip configured to limit insertion of the shell into the central opening of the roll of sheet product.

15. The core plug of claim 11, wherein the first arm and the second arm are arranged in a circumferential array.

16. The core plug of claim 1, wherein the plurality of spokes, the first arm, and the second arm have the same length.

17. A sheet product roll assembly for a sheet product dispenser, the sheet product roll assembly comprising:

a roll of sheet product having a first end and an opposite second end positioned along a longitudinal axis of the roll of sheet product, wherein the roll of sheet product comprises:

a plurality of layers of sheet product wound around one another; and an opening extending from the first end to the second end of the roll of sheet product;

a first core plug attached to the roll of sheet product at the first end of the roll of sheet product; and a second core plug attached to the roll of sheet product at the second end of the roll of sheet product;

wherein the first core plug and the second core plug each comprise:

a shell configured to be at least partially inserted into the opening of the roll of sheet product, the shell comprising:

a collar:

a cylindrical hub; and a plurality of spokes extending from the cylindrical hub to the collar; and a support removably coupled to the shell, the support comprising a body, a first arm, and a second arm, wherein at least the first arm contacts the collar during rotation of the roll of sheet product;

wherein the support is configured to move relative to the shell from a first position within the shell to a second position outside of the shell.

18. A sheet product dispensing system comprising:

a sheet product dispenser comprising:

a first support feature; and a second support feature spaced apart from the first support feature;

a roll of sheet product having a first end and an opposite second end positioned along a longitudinal axis of the roll of sheet product, wherein the roll of sheet product comprises:

a plurality of layers of sheet product wound around one another; and an opening extending from the first end to the second end of the roll of sheet product;

a first core plug attached to the roll of sheet product at the first end of the roll of sheet product; and a second core plug attached to the roll of sheet product at the second end of the roll of sheet product;

wherein the first core plug and the second core plug each comprise:

a shell configured to be at least partially inserted into the opening of the roll of sheet product, the shell comprising:

a collar;

a cylindrical hub; and a plurality of spokes extending from the cylindrical hub to the collar; and a support removably coupled to the shell, the support comprising a body, a first arm, and a second arm, wherein at least the first arm contacts the collar during rotation of the roll of sheet product;

wherein the support is configured to move relative to the shell from a first position within the shell to a second position outside of the shell.

* * * * *